US010370621B2

(12) United States Patent
Gaulard et al.

(10) Patent No.: US 10,370,621 B2
(45) Date of Patent: Aug. 6, 2019

(54) BLEACHING FORMULATIONS COMPRISING PARTICLES AND TRANSITION METAL ION-CONTAINING BLEACHING CATALYSTS

(71) Applicant: Chemsenti Limited, London (GB)

(72) Inventors: Fabien Pierre Guy Gaulard, Leiden (NL); Karin Maaijen, Leiden (NL); Ronald Hage, Leiden (NL)

(73) Assignee: Chemsenti Limited, London (GB)

( * ) Notice: Subject to any disclaimer, the term of this patent is extended or adjusted under 35 U.S.C. 154(b) by 316 days.

(21) Appl. No.: 15/044,462

(22) Filed: Feb. 16, 2016

(65) Prior Publication Data

US 2016/0160160 A1 Jun. 9, 2016

Related U.S. Application Data

(63) Continuation of application No. PCT/GB2014/052434, filed on Aug. 8, 2014.

(30) Foreign Application Priority Data

Aug. 16, 2013 (EP) ..... 13180686

(51) Int. Cl.

| | |
|---|---|
| ***C11D 3/39*** | (2006.01) |
| ***C11D 3/12*** | (2006.01) |
| ***C11D 3/386*** | (2006.01) |
| ***C11D 17/00*** | (2006.01) |

(52) U.S. Cl.

CPC ..... *C11D 3/3932* (2013.01); *C11D 3/12* (2013.01); *C11D 3/124* (2013.01); *C11D 3/126* (2013.01); *C11D 3/128* (2013.01); *C11D 3/38672* (2013.01); *C11D 3/3935* (2013.01); *C11D 17/0039* (2013.01)

(58) Field of Classification Search

None

See application file for complete search history.

(56) References Cited

U.S. PATENT DOCUMENTS

| | | | | |
|---|---|---|---|---|
| 1,246,339 A | | 11/1917 | Smit | |
| 3,332,882 A | | 7/1967 | Blumbergs et al. | |
| 3,586,478 A | | 6/1971 | Neumann | |
| 3,954,632 A | | 5/1976 | Gloss | |
| 4,128,494 A | | 12/1978 | Schirmann et al. | |
| 4,397,757 A | | 8/1983 | Bright et al. | |
| 4,412,934 A | | 11/1983 | Chung et al. | |
| 4,675,393 A | | 6/1987 | Coxon | |
| 4,751,015 A | | 6/1988 | Humphreys et al. | |
| 4,919,841 A | | 4/1990 | Kamel et al. | |
| 5,258,132 A | | 11/1993 | Kamel et al. | |
| 5,429,769 A | | 7/1995 | Nicholson et al. | |
| 5,536,441 A | * | 7/1996 | Chapple | C11D 3/3935 252/186.33 |
| 5,703,034 A | * | 12/1997 | Offshack | C11D 3/3932 510/220 |
| 6,432,900 B1 | | 8/2002 | Appel et al. | |
| 6,462,007 B1 | * | 10/2002 | Pieroni | C11D 3/0052 134/25.2 |
| 7,109,156 B1 | * | 9/2006 | Dykstra | C11D 3/3932 510/303 |
| 2001/0025695 A1 | | 10/2001 | Patt et al. | |
| 2003/0008796 A1 | | 1/2003 | Carina et al. | |
| 2005/0181964 A1 | | 8/2005 | Jonas et al. | |
| 2005/0209120 A1 | | 9/2005 | Reinhardt et al. | |
| 2009/0192069 A1 | * | 7/2009 | Schirmer-Ditze | C11D 3/168 510/446 |
| 2012/0017947 A1 | * | 1/2012 | Fernandez Prieto | C11D 3/38672 134/26 |
| 2012/0058927 A1 | * | 3/2012 | Borchers | C11D 3/3932 510/220 |
| 2012/0208739 A1 | | 8/2012 | Dykstra et al. | |
| 2012/0322708 A1 | * | 12/2012 | Lant | C11D 3/38636 510/101 |

FOREIGN PATENT DOCUMENTS

| | | |
|---|---|---|
| EP | 0040091 A1 | 11/1981 |
| EP | 0070074 A2 | 1/1983 |
| EP | 0120591 A1 | 10/1984 |
| EP | 0174132 A2 | 3/1986 |
| EP | 0185522 A2 | 6/1986 |
| EP | 0284292 A2 | 9/1988 |
| EP | 0303520 A2 | 2/1989 |
| EP | 0304331 A2 | 2/1989 |
| EP | 0328177 A2 | 8/1989 |
| EP | 0331229 A2 | 9/1989 |

(Continued)

OTHER PUBLICATIONS

[No Author Listed], "Ethocel: Ethylcellulose Polymers Technical Handbook," Dow Chemical Company, 2005, 1-28.

Alt, H. et al., "Mechanism of the Electrocatalytic Reduction of Oxygen on Metal Chelates," J. Catal., 1973, vol. 28, 8-19.

Dick, S. et al., "Reactions of smectites with binuclear oxo-bridged iron complexes of N-alkyl-N, N-bis(2-pyridylmethyl)amines," Clay Minerals, 1998, vol. 33, 35-42.

Fraile, J. M. et al., "Clay-supported non-chiral and chiral Mn(salen) complexes as catalysts for olefin epoxidation," J. Molec. Catal., 1998, vol. 136, 47-57.

Gilbert, B. C. et al., "Formation and reaction of O=$Mn^{v}$ species in the oxidation of phenolic substrates with $H_2O_2$ catalysed by the dinuclear manganese ($^{IV}$) 1, 4, 7-trimethyl-1, 4, 7-triazacyclononane complex $[Mn^{IV}2(\mu\text{-}O)_3(TMTACN)_2](PF_6)_2$," Org. Biomol. Chem., 2004, vol. 2, 1176-1180.

(Continued)

*Primary Examiner* — Katie L. Hammer

(74) *Attorney, Agent, or Firm* — McCarter & English, LLP; Yu Lu

(57) ABSTRACT

The present invention relates to bleaching formulations comprising transition metal ion-containing bleaching catalysts, which formulations additionally comprise coated particles having meltable cores that comprise an inorganic solid support material and/or a catalase enzyme; and to the coated particles per se. The invention also relates to uses of the bleaching formulations and the coated particles described herein in methods of bleaching.

20 Claims, No Drawings

(56) References Cited

FOREIGN PATENT DOCUMENTS

| | | | | |
|---|---|---|---|---|
| EP | 0346995 | A2 | 12/1989 | |
| EP | 0384070 | A2 | 8/1990 | |
| EP | 0458396 | A1 | 11/1991 | |
| EP | 0458397 | A2 * | 11/1991 | ..... C11D 3/3932 |
| EP | 0458397 | A2 | 11/1991 | |
| EP | 0464880 | A1 | 1/1992 | |
| EP | 0482806 | A1 | 4/1992 | |
| EP | 0530870 | A1 | 3/1993 | |
| EP | 0544440 | A2 | 6/1993 | |
| EP | 0616029 | A1 | 9/1994 | |
| EP | 0710713 | A2 | 5/1996 | |
| EP | 0710714 | A2 | 5/1996 | |
| EP | 0909809 | A2 | 4/1999 | |
| EP | 1001009 | A1 | 5/2000 | |
| EP | 1008645 | A1 | 6/2000 | |
| EP | 1557457 | A1 | 7/2005 | |
| EP | 2228429 | A1 | 9/2010 | |
| GB | 447710 | A | 5/1936 | |
| GB | 836988 | A | 6/1960 | |
| GB | 864798 | A | 4/1961 | |
| GB | 907356 | A | 10/1962 | |
| GB | 1003310 | A | 9/1965 | |
| GB | 1519351 | A | 7/1978 | |
| WO | WO-1995/07972 | A1 | 3/1995 | |
| WO | WO-1995/28467 | A1 | 10/1995 | |
| WO | WO-1995/34628 | A1 | 12/1995 | |
| WO | WO-1997/48787 | A1 | 12/1997 | |
| WO | WO-1998/39098 | A1 | 9/1998 | |
| WO | WO-1998/42818 | A1 | 10/1998 | |
| WO | WO-2000/12667 | A1 | 3/2000 | |
| WO | WO-2000/15750 | A1 | 3/2000 | |
| WO | WO-2000/34427 | A1 | 6/2000 | |
| WO | WO-2000/60045 | A1 | 10/2000 | |
| WO | WO-2001/05925 | A1 | 1/2001 | |
| WO | WO-2001/64827 | A1 | 9/2001 | |
| WO | WO-2002/02571 | A1 | 1/2002 | |
| WO | WO-2002/48301 | A1 | 6/2002 | |
| WO | WO-2002/068574 | A1 | 9/2002 | |
| WO | WO-2002/077145 | A1 | 10/2002 | |
| WO | WO-2002/088289 | A2 | 11/2002 | |
| WO | WO-2003/072690 | A1 | 9/2003 | |
| WO | WO-2003/104234 | A1 | 12/2003 | |
| WO | WO-2003/104379 | A1 | 12/2003 | |
| WO | WO-2005/049778 | A1 | 6/2005 | |
| WO | WO-2005/068074 | A2 | 7/2005 | |
| WO | WO-2006/125517 | A1 | 11/2006 | |
| WO | WO-2007/012451 | A1 | 2/2007 | |
| WO | WO-2008/003652 | A1 | 1/2008 | |
| WO | WO-2008/064935 | A1 | 6/2008 | |
| WO | WO-2010/020583 | A1 | 2/2010 | |
| WO | WO-2011/066934 | A1 | 6/2011 | |
| WO | WO-2011/066935 | A2 | 6/2011 | |
| WO | WO-2011/106906 | A1 | 9/2011 | |
| WO | WO-2011/128649 | A1 | 10/2011 | |
| WO | WO-2012/048951 | A1 | 4/2012 | |
| WO | WO-2012/071153 | A1 | 5/2012 | |
| WO | WO-2012/104159 | A1 | 8/2012 | |
| WO | WO-2013/040114 | A1 | 3/2013 | |

OTHER PUBLICATIONS

Hage, R. et al., "Applications of Transition-Metal Catalysts to Textile and Wood-Pulp Bleaching," Angew. Chem. Int. Ed. Eng., 2006, vol. 45, 206-222.

Hage, R., "Oxidation catalysis by biomimetic manganese complexes," Recl. Tray. Chim. Pays-Bas, 1996, vol. 115, 385-395.

Law, N. A. et al., "Manganese Redox Enzymes and Model Systems: Properties, Structures, and Reactivity," Adv. Inorg. Chem., 1999, vol. 46, 305-440.

Ramaraj, R. et al., "Oxygen Evolution by Water Oxidation with Polynuclear Ruthenium Complexes," J. Chem. Soc., Faraday Trans. 1, 1987, vol. 83, 1539-1551.

* cited by examiner

BLEACHING FORMULATIONS COMPRISING PARTICLES AND TRANSITION METAL ION-CONTAINING BLEACHING CATALYSTS

REFERENCE TO RELATED APPLICATIONS

This application is a continuation application of International Application No. PCT/GB2014/052434, filed on Aug. 8, 2014, which claims priority to European Patent Application No. EP13180686.1, filed on Aug. 16, 2013, the entire contents of both applications are incorporated herein by reference.

FIELD OF THE INVENTION

The present invention relates to bleaching formulations comprising transition metal ion-containing bleaching catalysts, which formulations additionally comprise coated particles having meltable cores that comprise an inorganic solid support material and/or a catalase enzyme; and to the coated particles per se. The invention also relates to uses of the bleaching formulations and the coated particles described herein in methods of bleaching.

BACKGROUND OF THE INVENTION

A wide variety of transition metal ion-based bleaching catalysts have been studied, which enhance the stain-bleaching activity in detergent formulations by hydrogen peroxide, peracids and even oxygen. For example, dinuclear manganese catalysts based on triazacyclononane ligands are known to be particularly active catalysts in the bleaching of stains in laundry detergent products and in machine dishwash products and for treatment of cellulosic substrates present in e.g. wood-pulp or raw cotton (see for example EP 0 458 397 A2 (Unilever NV and Unilever plc) and WO 2006/125517 A1 (Unilever plc et al.).

Most attention has been directed to the use of manganese and iron ion-containing bleaching catalysts in laundry cleaning products, although catalysts have also been investigated in the context of automatic dishwash products. Iron complexes containing pentadentate ligands are efficient in stain bleaching without the use of hydrogen peroxide or peracid in the detergent formulations. For a more complete overview of the different classes of bleaching catalysts developed and studied, reference is made to R Hage and A Lienke (*Angew. Chem., Int. Ed. Engl.,* 45, 206-222 (2006)).

Manganese salts and various manganese complexes are known to have a tendency to damage cellulose-containing (cellulosic) materials at certain temperatures, particularly in conjunction with hydrogen peroxide at high pH. The extent and damage profile depends, in part, on the catalyst employed, as is described, for example, in US 2001/0025695 A1 (Patt et al.). In this publication, there is a description of a far greater reduction in the viscosity of wood pulp cellulose when pulp was treated at high temperatures using a dinuclear manganese catalyst with 1,4,7-trimethyl-1,4,7-triazacyclononane ($Me_3TACN$) than when a similar dinuclear manganese catalyst based on an ethylene-bridged ligand (1,2-bis(4,7-dimethyl-1,4,7-triazacyclonon-1-yl)ethane) ($Me_4DTNE$) was used.

In WO 01/64827 A1 (Unilever plc et al.), there is described the use of catalase enzymes or mimics thereof to decompose hydrogen peroxide that is initially present in a bleaching medium, so as to increase the amount of a transition metal ion-containing complex available for bleaching with oxygen. Separately, there is described in the same publication the timed release of a bleaching species or source thereof or an enzyme contained in the form of a granulate. Granulation aids described include a wide variety of materials including talc and clays. There is no teaching or suggestion in this publication that any of the granulation aids described, let alone talc or clays, could inactivate either a bleaching species or source thereof or an enzyme contained in the form of a granulate with such a granulation aid.

EP 0 710 713 A2 and EP 0 710 714 (both The Proctor & Gamble Company), describe the use of clay mineral compounds and crystalline layered silicates respectively for the purpose of reducing the problem of fabric damage, particularly of fabric colour fading, in order to address the dual challenge of formulating a product which maximises bleach soil soil/stain removal that minimises the occurrence of unwelcome fabric damage.

It is known that inorganic solid support materials, such as clays, can adsorb metal-ligand complexes and metal ions via cationic exchange mechanisms. An example of adsorption of manganese complexes containing N,N-bis(salicylidene)-ethylenediamine) (salen) ligands is described by J M Fraile et al. (*J. Molec. Catal.,* 136, 47-57 (1998)). S Dick and A Weiss describe the adsorption of a dinuclear iron compound on clays (*Clay Material.,* 33, 35-42 (1998)). Other metal complexes have also been reported to bind onto clays, for example a ruthenium complex to achieve oxidation catalysis (see R Ramaraj et al., *J. Chem. Soc., Faraday Trans* 1, 83, 1539-1551 (1987)). Moreover, as well as the possibility of removing metal ions using various clays, other inorganic solid support materials including carbon black are also known to adsorb metal complexes efficiently (for an example of carbon black in this context, see, for example, H Alt et al. (*J. Catal.,* 28, 8-19 (1973)).

Whilst transition metal ion-containing bleaching catalyst have great utility in effecting bleaching of a variety of substrates, notably cellulosic substrates, the concomitant propensity to effect damage at certain combinations of pH, temperature and oxidising environment can be problematic. The present invention is intended to address this problem.

SUMMARY OF THE INVENTION

In order to try to allow transition metal ion-containing bleaching catalysts to be more widely used, we have found that damage to substrates caused by the use of transition metal ion-containing bleaching catalysts in oxidations may be controllably ameliorated by effecting controlled release of compounds that inactivate or lessen the activity of such catalysts towards substrate degradation at a predetermined temperature or temperature range. Since such damage can be mediated by the presence of hydrogen peroxide, we have found that temperature-triggered release of substances that adsorb the bleaching catalysts and/or that degrade hydrogen peroxide may be used to ameliorate undesirable damage to substrates subjected to catalytic bleaching reactions.

Viewed from a first aspect, therefore, the invention provides a bleaching formulation comprising one or more particles and, separately to the particles, a transition metal ion-containing bleaching catalyst, the particles comprising:

(i) a core comprising either an inorganic solid support material selected from the group consisting of clays, aluminium silicates, silicates, silicas, carbon black and activated carbon or a catalase enzyme or a mimic thereof; and an amount of about 0 to about 10 wt % of a transition metal ion-containing bleaching catalyst, the amount of the catalyst being with respect to the weight of the core; and (ii) a coating encapsulating the core, which comprises a material that melts a temperature of between about 30° C. and about 90° C., with the proviso that, where the inorganic solid support material is talc or a clay, the core does not comprise a peroxy compound or source thereof or a catalase enzyme or mimic thereof.

Viewed from a second aspect, the invention provides a particle as defined in accordance with the first aspect of the invention.

Viewed from a third aspect, the invention provides a method comprising contacting a substrate with water and a bleaching formulation, the bleaching formulation comprising one or more particles and, separately to the particles, a transition metal ion-containing bleaching catalyst, the particles comprising:

(i) a core comprising either an inorganic solid support material selected from the group consisting of clays, aluminium silicates, silicates, silicas, carbon black and activated carbon or a catalase enzyme or a mimic thereof; and an amount of about 0 to about 10 wt % of a transition metal ion-containing bleaching catalyst, the amount of the catalyst being with respect to the weight of the core; and (ii) a coating encapsulating the core, which comprises a material that melts at a temperature of between about 30° C. and about 90° C., characterised in that the temperature of the mixture resultant from the contacting is set to be no higher than that at which the coating material melts.

Viewed from a fourth aspect, the invention provides a method comprising contacting a substrate with water and a bleaching formulation of the first aspect of the invention.

Viewed from a fifth aspect, the invention provides the use of a particle defined in accordance with the third aspect of the invention to protect against damage to a cellulosic substrate contacted with water and a bleaching formulation comprising a transition metal ion-containing bleaching catalyst.

Further aspects and embodiments of the invention will be evident from the discussion that follows below.

DETAILED DESCRIPTION OF THE INVENTION

As summarised above, the present invention is based on the finding that temperature-triggered release of substances that adsorb transition metal ion-containing bleaching catalysts and/or that degrade hydrogen peroxide found in liquid (generally aqueous) media in which oxidations catalysed by such bleaching catalysts may be used can ameliorate undesirable damage to, or defect control over degradation to, substrates subjected to catalytic bleaching reactions.

According to the first aspect of the invention, there is provided a bleaching formulation comprising one or more coated particles the cores of which comprise an inorganic solid support material and/or a catalase enzyme. The inorganic solid support material is suitable for adsorbing a transition metal ion-containing bleaching catalyst. Separately to the coated particles, the bleaching formulation comprises a transition metal ion-containing bleaching catalyst. Bleaching formulations, such as those of the invention, are suitable for effecting catalytic oxidation (e.g. bleaching) of substrates, for example according to the methods of the third and fourth aspects and use of the fifth aspect of the present invention.

A transition metal ion-containing bleaching catalyst, which is generally but not necessarily a salt, is present in the bleaching formulations described herein. This can catalyse the oxidising activity of a peroxy compound, which may either be included within these bleaching formulations, or may be generated from such bleaching formulations in situ.

Where a peroxy compound is present in a bleaching formulation described herein, this may be, and typically is, a compound which is hydrogen peroxide, or is capable of yielding hydrogen peroxide in aqueous solution. Suitable amounts of peroxy compounds to include within a bleaching formulation may be determined without undue burden by the skilled person although typical quantities will be within the range of 1-35 wt %, for example 5-25 wt %, based on the solids content of the bleaching formulation. One of skill in the art will appreciate that smaller quantities of peroxy compounds than these may be used where the bleaching formulation comprises a bleaching system (discussed below) comprising a peroxy compound and a so-called bleach precursor. For example, where hydrogen peroxide or (more typically) sources thereof, such as perborate or percarbonate salts, including optionally hydrated sodium perborate and sodium percarbonate, are used in conjunction with a bleach precursor, for example, TAED or SNOBS, the bleaching formulations may comprise from 0.1% to 10 wt %, preferably 0.2 to 8 wt %, of the peroxy compound.

Suitable hydrogen peroxide sources are well known in the art. Examples include the alkali metal peroxides, organic peroxides such as urea peroxide, and inorganic persalts, such as alkali metal perborates, percarbonates, perphosphates, persilicates, and persulfates. Typical peroxy compounds included within bleaching formulations are hydrogen peroxide or persalts, for example hydrogen peroxide and perborate or percarbonate salts. Often the persalt is optionally hydrated sodium perborate (e.g. sodium perborate monohydrate and sodium perborate tetrahydrate) or sodium percarbonate. According to particular embodiments, bleaching formulations according to the invention comprise sodium perborate monohydrate or sodium perborate tetrahydrate. Inclusion of sodium perborate monohydrate is advantageous owing to its high active oxygen content. Use of sodium percarbonate is also advantageous for environmental reasons and is consequentially more widely used in bleaching formulations.

As an alternative to the use of inorganic persalts, organic peroxides may also be used. For example, alkylhydroxy peroxides are another class of peroxy bleaching compounds. Examples of these materials include cumene hydroperoxide and t-butyl hydroperoxide.

Organic peroxy acids may also serve as the peroxy compound. These may be mono- or diperoxyacids. Typical mono- or diperoxyacids are of the general formula HOO—(C═O)—R—Y, wherein R is an alkylene or substituted alkylene group containing from 1 to about 20 carbon atoms, optionally having an internal amide linkage or a phenylene or $C_{1-18}$alkyl-substituted phenylene group; and Y is hydrogen, halogen, alkyl, aryl, an imido-aromatic or non-aromatic group, a COOH or (C═O)OOH group or a quaternary ammonium group.

Typical monoperoxy acids include peroxy benzoic acids, peroxy lauric acid, N,N-phthaloylaminoperoxy caproic acid (PAP) and 6-octylamino-6-oxo-peroxyhexanoic acid. Typical diperoxy acids include for example: 1,12-diperoxydodecanoic acid (DPDA) and 1,9-diperoxyazeleic acid.

As well as organic peroxyacids, inorganic peroxyacids are also suitable, for example potassium monopersulfate (MPS).

If organic or inorganic peroxyacids are included within bleaching formulations, the amount of them incorporated in a bleaching formulation will typically be within the range of about 2% to 10 wt %, preferably 4 to 8 wt %.

The bleaching formulation need not necessarily comprise a peroxy compound, however: a bleaching formulation of the invention may instead comprise a bleaching system constituted by components suitable for the generation of hydrogen peroxide in situ, but which are not themselves peroxy compounds. An example of this is the use of a combination of a $C_{1-4}$ alcohol oxidase enzyme and a $C_{1-4}$ alcohol, for example a combination of methanol oxidase and ethanol. Such combinations are described in WO 95/07972 A1 (Unilever N.V. and Unilever plc).

Often, a bleaching species is generated in situ. For example, organic peroxyacids are often generated in situ, as opposed to being included within the bleaching formulation, peroxyacids themselves tending to be insufficiently stable for prolonged storage. For this reason, bleaching formulations often comprise a bleaching system comprising a persalt (e.g. sodium perborate (optionally hydrated) or sodium percarbonate), which yields hydrogen peroxide in water; and a so-called peroxy bleach precursor capable of reacting with the hydrogen peroxide to generate an organic peroxyacid.

The skilled person is very familiar with the use of bleaching systems comprising peroxy bleach precursors, peroxy bleach precursors being well known to the skilled person and described in the literature. For example, reference in this regard is made to British Patents 836,988, 864,798, 907,356, 1,003,310 and 1,519,351; EP 0 185 522 A, EP 0 174 132 A, EP 0 120 591 A; and U.S. Pat. Nos. 1,246,339, 3,332,882, 4,128,494, 4,412,934 and 4,675,393.

Useful peroxyacid bleach precursors are the cationic, quaternary ammonium-substituted peroxyacid bleach precursors described in U.S. Pat. Nos. 4,751,015 and 4,397,757; and in EP 0 284 292 A and EP 0 331 229 A. Examples of such peroxyacid bleach precursors include 2-(N,N,N-trimethyl ammonium) ethyl sodium-4-sulfonphenyl carbonate chloride (SPCC) and N,N,N-trimethyl ammonium toluyloxy benzene sulfonate.

A further special class of bleach precursors is formed by the cationic nitriles described in EP 0 303 520 A, EP 0 458,396 A and EP 0 464,880 A. Other classes of bleach precursors for use with the present invention are described in WO 00/15750 A1, for example 6-(nonanamidocaproyl) oxybenzene sulfonate.

Typically, peroxy bleach precursors are esters, including acyl phenol sulfonates and acyl alkyl phenol sulfonates; the acyl-amides; and quaternary ammonium substituted peroxyacid bleach precursors, including the cationic nitriles. Examples of typical peroxyacid bleach precursors (sometimes referred to as peroxyacid bleach activators) are sodium-4-benzoyloxy benzene sulfonate (SBOBS); N,N,N',N'-tetraacetylethylenediamine (TAED); sodium 1-methyl-2-benzoyloxy benzene-4-sulfonate; sodium-4-methyl-3-benzoloxy benzoate; trimethylammonium tolyloxy benzene sulfonate; sodium-4-sulfophenyl carbonate chloride (SPCC); sodium nonanoyloxybenzene sulfonate (SNOBS); sodium, 3,5,5-trimethyl hexanoyloxybenzene sulfonate (STHOBS); and the substituted cationic nitriles. Often, bleach precursor compounds used are TAED and salts of nonanoyloxybenzene sulfonate (NOBS), e.g. the sodium salt SNOBS.

Peroxy compounds or bleaching systems as described herein can be stabilised within a bleaching formulation by providing them with a protective coating, for example a coating comprising sodium metaborate and sodium silicate.

The oxidative power of the peroxy compound present in or generated from the bleaching formulation is catalysed by the presence of the transition metal ion-containing bleaching catalyst that is separate to the coated particles of the bleaching formulations described herein. The oxidative environment of an aqueous medium (e.g. water) with which the bleaching formulation of the invention is contacted is reduced if the contents of the cores of the coated particles described herein are released; this is triggered by their environment reaching a temperature at which the coatings of the particles melt.

The cores of the coated particles described herein comprise either (i) an inorganic solid support material suitable for adsorbing a transition metal ion-containing bleaching catalyst; or (ii) a catalase enzyme or a mimic thereof. Generally, the particles will comprise only one of these. However, coated particles comprising both an inorganic solid support material and a catalase enzyme or mimic thereof are also embraced within the scope of embodiments of the present invention. Also embraced within the various aspects of this invention are embodiments in which pluralities of particles are provided, some of which comprise an inorganic solid support material and some of which comprise catalase enzyme or a mimic thereof.

The inorganic solid support material is suitable for adsorbing a transition metal ion-containing bleaching catalyst. Without wishing to be bound to theory, one of the main adsorption mechanisms of transition metal ion-containing bleaching catalyst occurs by way of cationic exchange between, for example, alkali or alkaline earth metal ions present in the coated particles' cores' inorganic support material and transition metal ions of cationic transition metal ion-containing bleaching catalysts. Adsorption in this way is very well known to the skilled person, not least since effecting adsorption in this way is used to prepare, for example, heterogeneous catalysts. Advantageously, an inorganic solid support material will exhibit a large surface area in combination with a large number of acidic groups, either in the form of acidic groups per se or as metal salts thereof (for example, sodium, potassium, calcium or magnesium salts), in order to increase the capacity to adsorb cationic bleaching catalysts. For example, the highly porous material activated carbon may be used in accordance with the present invention. This inorganic support material is made by treatment of various organic carbonaceous materials, whereby oxidation of the surface occurs. Carbon black, another inorganic support material having high surface area, may also be used although, unlike activated carbon, it is generally not surface-oxidised.

It is to be understood that the inorganic solid support material is suitable for adsorbing transition metal ion-containing bleaching catalysts in, for example as may be included in the bleaching formulations of or used according to the invention, but separate to the coated particles thereof. However, as is known, other species may be formed from the initial transition metal ion-containing bleaching catalysts included in such bleaching formulations and these other species may likewise be adsorbed. For example, as is discussed by B C Gilbert et al. (*Org. Biomol. Chem.*, 2, 1176-1180 (2004)), dinuclear Mn-$Me_3$-TACN species and hydrogen peroxide may react with substrates to yield cationic mononuclear Mn-$Me_3$-TACN species. Such species may also be adsorbed on the inorganic solid support materials described herein.

The inorganic solid support material is or comprises a clay, an aluminium silicate (e.g. a zeolite), a silicate, a silica, activated carbon or carbon black. More than one of these classes of materials and/or more than one compound within any given class may be comprised within the cores of the coated particles described herein. Generally, however a single type of material will be used.

To avoid ambiguity, the terminology recommended by the International Union of Pure and Applied Chemistry (IUPAC) for the description of carbon as a solid (see *Pure & Appl. Chem.,* 67(3), 473-506 (1995)) is adopted herein as regards the definitions of carbon black and activated carbon. In particular, carbon black is defined by IUPAC as an industrially manufactured, colloidal carbon material in the form of spheres and of their fused aggregates with sizes below 1000 nm; manufactured, under controlled conditions, by thermal decomposition or incomplete combustion of carbon hydrogen compounds; and having a well-defined morphology with a minimum content of tars or other extraneous materials. Activated carbon is defined by IUPAC as a porous carbon material, a char which has been subjected to reactions with gases, sometimes with the addition of chemicals before, during or after carbonisation in order to increase its absorptive properties.

An extended description of clays, silica, silicate and zeolite materials can be found in, for example, *Chemistry of the Elements*, by NN Greenwood and A Earnshaw (Pergamon Press, 1984, Oxford, UK)). A briefer discussion of these follows below.

Silica-containing material may be used as the inorganic solid support material. Notable amongst silica-based materials is silica gel, which is an amorphous form of $SiO_2$. Prepared by acidification of aqueous solutions of sodium silicate, silica gels have a very porous structure. Silica gels are well known for having large surface area and adsorptive capacity, including for transition metal ion-containing bleaching catalysts. Non-limiting commercially available examples include those supplied by PQ Corporation (e.g. Gasil 23D and Neosyl TS) and Evonik (e.g. Aerosil 200, Aerosil 380, Aeroperl 300/30).

Silicates are widely available commercially, a large number of silicate minerals being abundant on Earth. Many commercially available silicates are thus of natural origin although synthetic (i.e. man-made) silicates can be prepared without undue burden by the skilled person, for example by calcining an appropriate oxide with silica at an elevated temperature.

By silicate is meant herein, as it is understood in the art, an anion consisting of one or more $SiO_4$ tetrahedra, or, exceptionally, $SiO_6$ octahedra. It will be understood that the term "silicate" does not embrace aluminium silicates (i.e. aluminosilicates) or silica (e.g. silica gels or hydrogels). In principle any silicate that contains cations that exchange by other cations may be used according to the present invention. Non-limiting commercial examples include those commercially available from PQ Corporation (e.g. Microcal ET) and Evonik (e.g. Ultrasil 880 and Ultrasil AS7).

The family of aluminium silicates have a 3-dimensional structure and, besides zeolites, also embraces feldspars and ultramarines. According to the present invention, where the inorganic solid support material is an aluminium silicate, this is typically a zeolite. Use of zeolites is advantageous since they have a particularly open structure and are therefore particularly suitable for exchanging cations. Whilst many zeolites are capable of binding small cations, such as $Ca^{2+}$, various zeolites, such as zeolite X, have large pores and can also bind larger cationic molecules. Non-limiting commercial examples of zeolites useful according to the present invention include those supplied by PQ corporation (such as Doucil 4A, 24A and MAP), Tricat (ZSM and 13× zeolites) and FMC Foret (Zeolite A4).

According to particular embodiments of the invention, the inorganic solid support material of the coated particles described herein is a clay. As is known, clay minerals are often defined as hydrous (that is to say, hydrated) aluminium-containing layered silicates (phyllosilicates) divided into a number of different classes, although other phyllosilicates, notably magnesium-based phyllosilicates, such as the smectite clay hectorite, are generally considered, and are to be considered herein, to be clays.

Clays comprise layers of hexagonal $SiO_4$ tetrahedra that share three of their four oxygen atoms with adjacent tetrahedra, whereby to form an extended hexagonal array, often referred to a tetrahedral sheet. The fourth oxygen atoms of the $SiO_4$ tetrahedra in clays are each disposed on the same face of the hexagonal array. These "fourth oxygen atoms" of clays' tetrahedral sheets form part of a further type of sheet within clays—the so-called octahedral sheet—which comprises octahedrally coordinated aluminium or magnesium ions, i.e. which are coordinated by six oxygen atoms. Additional oxygen atoms (other than those provided by the oxygen atoms of the tetrahedral sheet), are provided by hydroxyl groups.

The manner in which the tetrahedral and octahedral sheets are disposed in layers defines, in part, different classes of clay. Clays having layers that comprise one tetrahedral sheet and one octahedral sheet are known as 1:1 clays; 2:1 clays have layers that comprise two tetrahedral sheets and one octahedral sheet, with the "fourth oxygen atoms" of the two tetrahedral sheets facing each other.

The octahedrally coordinated magnesium or aluminium ions in clays may be considered to be within a crystal lattice. Charge development in clays mainly arises from isomorphous substitution of the ions of these crystal lattices, for example where a proportion of aluminium ions is substituted for magnesium ions, or a proportion of magnesium ions are substituted for lithium ions. Such isomorphous substitution leads to the development of negative charge within the sheets of clays. Such charge is balanced by the presence of cations found between the layers within clays. These interlayer cations are typically ions of alkali or alkaline earth metals.

Notable amongst the various classes of clay is the smectites, the members of which swell when immersed in water and are further characterised by very high cation exchange capacities. Examples of smectites include montmorillonite, hectorite, saponite and vermiculite. Smectites are 2:1 clays.

Montmorillonite is the principal component of bentonite, a naturally occurring aluminium-based smectite clay with isomorphous magnesium ion substitution and interlayer cations. The constitution of bentonite varies depending, amongst other factors, on the relative proportion of these interlayer cations, typically sodium and calcium, and bentonite is often referred to as sodium montmorillonite, including in some standard inorganic chemistry texts (for example *Chemistry of the Elements* (vide supra)). Calcium-dominant montmorillonite (sometimes referred to as calcium bentonite) can be at least partially converted to bentonite (i.e. sodium montmorillonite) by treatment of the wet montmorillonite with a soluble sodium salt, a process originally discovered in the 1930s (see, for example, British Patent Nos 447,710 and 458,240). As used herein, unless the context expressly dictates to the contrary, bentonite is used to denote montmorillonite in which its interlayer cations comprise at least about 5 mol % sodium ions, for example between about 5 to about 80 mol % sodium ions.

Clays are abundant on Earth, i.e. naturally available. However, because natural clays possess inevitable impurities, synthetic clays and modified natural clays are also commercially available, for example synthetic hectorite, or can be prepared without undue burden according to the knowledge of those of skill in the art. Commercially available synthetic hectorite is sold under the trade name Laponite. The invention contemplates the use of naturally occurring, modified natural and synthetic clays.

According to particular embodiments of the invention, the clay used according to the various aspects and embodiments of the invention is a smectite, more particularly a montmorillonite, saponite or hectorite, in particular a montmorillonite such as, i.e. in the form of, bentonite, in which the interlayer cations comprise between about 5 and about 100, e.g. between about 5 and about 80, mol % sodium, lithium or potassium ions, often sodium ions.

As an alternative to the use of the inorganic solid support materials described herein or, according to some embodiments, in addition to the use of such inorganic solid support materials, the core of the coated particles described herein may comprise a catalase enzyme or a mimic thereof. Catalase enzymes are available commercially (e.g. from Novozymes). As an alternative to the use of enzymes, the skilled person is familiar with the use of catalase enzyme mimics, which have been described, for example, by R Hage (*Recl. Trav. Chim. Pays-Bas,* 115, 385-395 (1996)) and N A Law et al. (*Adv. Inorg. Chem.,* 46, 305-440 (1999)).

Typically, where a catalase enzyme or mimic thereof is incorporated into the coated particles' cores, it has been mixed with an inert material (i.e. one with which the catalase or mimic thereof does not react) prior to application of the coating. When using a catalase enzyme, commercially available aqueous solutions may be used. The catalase enzyme within such solutions may be supported on a suitable solid material, such as calcium carbonate or an inorganic solid support material as described herein, such as a zeolite, to form the core of the coated particles described herein before applying the temperature-sensitive coating. According to particular embodiments of the invention, catalase-containing cores comprise calcium carbonate- or zeolite-supported catalase. Other suitable inert materials will be evident to the skilled person. Alternatively, since lyophilised catalase enzymes are available commercially, for example from Novozymes, the temperature-sensitive coating may be applied directly to such solid, unsupported enzyme.

When the catalase enzyme is supplied as a solid material, it may be co-granulated with water-soluble supports, such as sodium chloride, sodium sulfate, calcium carbonate, urea, citric acid, lactose and the like. Also water-insoluble supports such as clays or zeolites may be applied.

When using a catalase enzyme mimic, it will often be in the form of a well-defined solid transition-metal catalyst salt. Such salts may be coated to provide embodiments of the coated particles described herein a modification of the procedures described in various patent publications for e.g. bleach catalysts used in detergent formulations (by substitution of the bleach catalyst for a catalase mimic). Suitable, non-limiting, examples can be found in EP 0 544 440 A (Unilever PLC et al.), WO 2013/040114 (The Procter & Gamble Company), WO 2007/012451 A1 (Clariant Produkte (Deutschland) GmbH), WO 2008/064935 (Henkel AG & Co. KGaA).

Where present, the amount of catalase mimic within coated particles' cores is typically between about 0.5 and about 10 wt %, for example between about 0.5 and about 5 wt %, with respect to the weight of the particles' cores.

The most appropriate quantity of the inorganic solid support materials described herein to include in a bleaching formulation of or used according to the invention will depend on the efficiency of binding of the transition metal ion-containing bleaching catalyst onto the inorganic solid support material and the extent to which it is desired to remove catalytically active transition metal ion-containing species from aqueous solution. Generally, an inorganic solid support material, if present, will be present in a bleaching formulation in an amount of between about 0.002 and about 20 wt %.

Similarly, the most appropriate quantity of catalase enzyme or mimic thereof to include in a bleaching formulation of or used according to the invention will depend on the efficiency with which the enzyme or mimic degrades hydrogen peroxide and the extent to which it is desired to remove hydrogen peroxide from solution.

Generally, a catalase enzyme, if present, will be present in the bleaching formulation in a sufficient quantity to decompose all hydrogen peroxide present in the environment into which it is released quickly, such as within 5 minutes. The amount of catalase enzyme is typically denoted as units activity, which has been defined in, for example, Methods in Biotechnology, H.-P. Schmauder Ed., Taylor and Francis Ltd, 1997 (page 100). For a typical detergent bleaching solution, it may be desirable to decompose approximately 10,000 μmol hydrogen peroxide within 5 min, or 2000 μmol within one minute. The activity of the enzyme should therefore be around 2,000 units (U) per liter of hydrogen peroxide-containing solution. Therefore a typical concentration range is between 500 and 10,000 units of the enzyme, per liter of hydrogen peroxide-containing solution into which it may be desired to be released. The skilled person can thus formulate a suitable bleaching formulation comprising coated catalase-containing particles to this end. Likewise, it will be understood that other bleaching formulations comprising catalase-containing particles can be formulated where the amount of hydrogen peroxide it may be desired to decompose is different.

Suitable amounts of inert material to be included within catalase-containing cores will depend on the amount of enzyme (in activity units, vide supra) to be present in the particles' cores and the activity of enzyme per ml solution provided by the enzyme supplier. If, for example, catalyst-containing particles were to be used at a 1 wt-% level with respect to the total weight of a bleaching formulation, and the weight ratio of inert support within the core to the particles' coating=1:1, and the dosage of bleaching formulation is 6 g/l of the solution, approximately 30 mg per liter of the inert support will be present in the dosage (or as range between 10 and 100 mg per liter insert support). Assuming a typical range of 500 and 10,000 units catalase/liter, the range of catalase enzyme (in units) will be preferably between 5 and 1,000 units/mg inert support.

A catalase enzyme mimic, if present in the coated particles described herein, will typically be present in a bleaching formulation of the used according to the invention in an amount of between about 0.1 mg and 20 mg per liter of hydrogen peroxide-containing solution to which it may be released upon melting of the particles' coatings.

Whilst the cores of the coated particles described herein need not necessarily be wholly absent transition metal ion-containing bleaching catalyst, it will be recognised that, since the intention behind the invention is to provide, controllably, a source of material that serves to lessen the oxidative effect of a medium in which oxidation is catalysed by a transition metal ion-containing bleaching catalyst, there is no particular advantage in the cores of the coated particles described herein containing any transition metal ion-containing bleaching catalyst. It will thus generally be desirable to keep the concentration of any transition metal ion-containing bleaching catalyst within the core of the coated particles to a minimum.

According to particular embodiments, therefore, the cores of the coated particles described herein consist essentially of inorganic solid support material and catalase enzyme or mimic thereof. By this is meant that the presence of additional components within the coated particles' cores is permitted, provided the amounts of such additional components do not materially affect the essential characteristics of the coated particles. Given that the intention behind including the inorganic support material and/or catalase enzyme or mimic thereof in the coated particles' cores is to reduce the oxidative propensity of a medium comprising hydrogen peroxide and a transition metal ion-containing bleaching catalyst, it will be understood that the inclusion of compounds, in particular transition metal ion-containing bleaching catalysts that materially affect, in particular increase, the oxidative propensity of the medium into which the cores of the coated particles are exposed upon melting of the coated particles' coatings, is excluded from cores that consist essentially of support material and catalase enzyme or mimic thereof. On the other hand, it will be understood that the presence of any inert solid material, such as, for example, that to which any catalase (or catalase mimic), if present in the coated particles' cores, may be adsorbed or and mixed, will not materially affect the essential characteristics of the coated particles.

Typically, the cores of the coated particles described herein will be absent transition metal ion-containing bleaching catalysts. It will also be understood that the coated particles' cores will often be absent peroxy compounds or any sources thereof for the same reason.

The cores of the coated particles described herein are coated with a material that encapsulates them. Typically, the coating will constitute between about 10 and about 90 wt %, often between about 30 and about 70 wt %, of the coated particles' total weight.

The coated particles' coating material is selected to melt at a temperature of between about 30° C. and about 90° C., for example between about 40° C. and about 90° C. Typically, the coating material will not melt at a discrete temperature, particularly if it comprises a mixture of compounds, but will have an inherent melting range across which the coating material transforms from a solid to a liquid. The coating material will be solid at ambient temperatures (generally in the range of about 15° C. to about 25° C.) and the requirement that it melts at the temperature of between about 30° C. and about 90° C. means that the coating material will serve to encapsulate the coated particles' cores in most storage environments.

Since the coating comprises a material that melts between about 30° C. and about 90° C., the coating may be regarded as comprising, or consisting essentially of, a wax. As is known, waxes are essentially a functionally defined class of substances, which comprise thermoplastic water-repellent lipid substances having low softening temperatures, formed from long-chain fatty acids and alcohols and secreted by animals or which form a protective outer layer on plants; and various mineral and synthetic organic compounds, generally hydrocarbons, having similar properties to naturally occurring lipid waxes. It is to be understood that long-chain fatty acid soaps, in which the acidic hydrogen atom of the long chain fatty acid has been replaced by an alkali metal ion, such as $Li^+$, $Na^+$, and $K^+$, typically $Na^+$, and long chain fatty acid esters, preferably mono-, di-, and tri-(long chain fatty acid) glycerol esters are to be considered waxes. Many naturally occurring and synthetic waxes comprise mixtures of compounds and so, therefore, may the coating material of the coated particles described herein, although the coated particles' coatings may comprise a single type of compound.

It will be understood that the exact nature of the coating material is not particularly critical, other than it generally being selected to have a desired melting point range, chosen, for example, on the basis of a temperature above which it may be desired to adsorb a particular bleaching catalyst, so as to diminish or abolish catalytic activity towards bleaching resultant from inclusion of such a catalyst. The concept of encapsulation within waxy substances, and methods of achieving such encapsulation, is well-known to the skilled person. In this regard, reference is made to WO 98/42818 (The Proctor & Gamble Company), which describe methods for producing coated particles that may be coated with waxes, for example silicone waxes, paraffin waxes and microcrystalline waxes; and to U.S. Pat. Nos. 4,919,841 and 5,258,132 (both to Kamel et al.), and which describes the preparation of wax-encapsulated materials. For example, particles' core materials may be encapsulated by spraying molten wax onto them in a fluidised bed. Other methods of encapsulation will be at the disposal of the skilled person.

According to some embodiments, the coating material may be a paraffin wax, including those described in EP 0 040 091 A1 (Unilever plc & Unilever N.V.). Paraffin waxes are widely available commercially from, for example, Merck, of Darmstadt (Germany) and Boler, of Wayne, Pa. (USA). Petroleum (paraffin) waxes of the microcrystalline type, melting at various temperatures, may be employed. Suitable micro-crystalline waxes include Shell micro-crystalline wax-HMP, and -W4, and micro-crystalline waxes sold by Witco, and many other suppliers. Other suitable waxes include Fischer-Tropsch and oxidised Fischer-Tropsch waxes, ozokerite, ceresin, montan wax, beeswax, candelilla wax (melting point between 68-70° C.), and carnauba wax (melting point between 80-88° C.), and spermaceti, and other ester waxes having a saponification value less than 100.

Other natural waxes or derivatives thereof that may be used as the coating material include waxes derived from animals or plants, e.g. of marine origin. Examples of such waxes include hydrogenated ox tallow, hydrogenated palm oil, hydrogenated cotton seeds and/or hydrogenated soy bean oil, wherein the term "hydrogenated" as used herein is to be construed as saturation of unsaturated carbohydrate chains, e.g. in triglycerides, wherein C=C double bonds are converted to C—C single bonds. Hydrogenated palm oil is commercially available e.g. from Hobum Oele und Fette GmbH—Germany or Deutsche Cargill GmbH—Germany. Fatty acid alcohols, such as the linear long chain fatty acid alcohol NAFOL 1822 (C18, C20, C22) from Condea Chemie GMBH—Germany, having a melting point between 55-60° C., may also be employed, as may polyethylene-based waxes.

Other waxes that may be employed, typically constituting less than 50% by weight of the particles' coating, are partial esters of polyhydric alcohols such as $C_{12}$ to $C_{20}$ acid esters of glycerol and sorbitan. Glycerol monostearate is a preferred member of this class. Mixtures of these waxes and waxy materials may be employed. Silicone-based waxes may also be employed according to the present invention.

Because, in part, of the ability to tailor the melting point (range) of the coating material, the melting point/range of particles may, and generally will, reflect the bleaching catalyst present in the bleaching formulations described herein that is separate to the coated particles. For example, if a bleaching catalyst is comparatively inactive towards damaging cotton or other cellulosic material, except at a high temperature (e.g. >60° C.), it may be desirable to use a coating material that melts at or approaching such a temperature, e.g. at or around 50° C. An example of such a bleaching catalyst is one comprising the complex $[Mn^{III}Mn^{IV}(\mu\text{-}O)_2(\mu\text{-}CH_3COO)(Me_4\text{-}DTNE)]^{2+}$, as is described in US 2001/0025695. At high temperature, the activity of this catalyst may be such that some cellulose damage is observed, especially after several washes. Accordingly, exposure of the coated particles' cores may only be desirable at high temperatures, such as at about 50 to 70° C. Conversely, bleaching catalysts comprising the complex $[Mn^{IV}Mn^{IV}(\mu\text{-}O)_3(Me_3\text{-}TACN)_2]^2$ exhibit a greater tendency towards damage of cellulose, as is also evident from data described in US 2001/0025695. For such catalysts, therefore, it is may be desirable to accompany them in bleaching formulations with particles having coatings that melt at lower temperatures, i.e. to prevent cellulosic damage becoming too significant. Accordingly, for bleaching formulations comprising such catalysts, use of coating materials that melt between about 30 and about 50° C., for example at about 40 to about 50° C. or at about 40 to about 45° C., may be desirable.

Transition metal ion-containing bleaching catalysts, for example as are often included in detergent products, are extraordinarily well known, studied and understood by the skilled person. For example, the following non-limiting list provides examples of patent publications that describe different classes of transition metal ion-containing bleaching catalysts suitable for use according to the various aspects of the present invention: EP 0 485 397, WO 95/34628, WO 97/48787, WO 98/39098, WO 00/12667, WO 00/60045, WO 02/48301, WO 03/104234, EP 1 557 457, U.S. Pat. No. 6,696,403, U.S. Pat. No. 6,432,900, US 2005/0209120 and US 2005/0181964.

Typically, the bleaching catalyst is formed from and comprises a polydentate ligand containing 3 to 6 nitrogens atoms, which atoms coordinate to a transition metal ion of the catalyst. Ions of the transition metals iron and manganese are typically used. The polydentate ligand is typically in the form of a complex of the general formula (A1):

$$[M_aL_kX_n]Y_m \quad \text{(A1)}$$

in which:

M represents a transition metal ion selected from Mn(II)-(III)-(IV)-(V), Cu(I)-(II)-(III), Fe(II)-(III)-(IV)-(V), Co(I)-(II)-(III), Ti(II)-(III)-(IV), V(II)-(III)-(IV)-(V), Mo(II)-(III)-(IV)-(V)-(VI) and W(IV)-(V)-(VI), typically selected from Fe(II)-(III)-(IV)-(V), Mn(II)-(III)-(IV)-(V) or Co(I)-(II)-(III), most typically selected from Mn(II), Mn(III), Mn(IV), Mn(V), Fe(II), Fe(III), or Fe(IV);

L represents a polydentate ligand as described herein, or a protonated or deprotonated derivative thereof;

each X independently represents a coordinating species selected from any mono, bi or tri charged anions and any neutral molecules able to coordinate a transition metal ion in a mono, bi or tridentate manner, preferably selected from $O^{2-}$, $RBO_2^{2-}$, $RCOO^-$, $RCONR^-$, $OH^-$, $NO_3^-$, NO, $S^{2-}$, $RS^-$, $PO_4^{3-}$, $PO_3OR^{3-}$, $H_2O$, $CO_3^{2-}$, $HCO_3^-$, ROH, $N(R)_3$, $ROO^-$, $O_2^{2-}$, $O_2^-$, RCN, $Cl^-$, $Br^-$, $OCN^-$, $SCN^-$, $CN^-$, $N_3^-$, $F^-$, $I^-$, $RO^-$, $ClO_4^-$, and $CF_3SO_3^-$, and more preferably selected from $O^2$, $RBO_2^{2-}$, $RCOO^-$, $OH^-$, $NO_3^-$, $S^{2-}$, $RS^-$, $PO_3^{4-}$, $H_2O$, $CO_3^{2-}$, $HCO_3^-$, ROH, $N(R)_3$, $Cl^-$, $Br^-$, $OCN^-$, $SCN^-$, RCN, $N_3^-$, $F^-$, $I^-$, $RO^-$, $ClO_4^-$, and $CF_3SO_3^-$;

each R independently represents a group selected from hydrogen, hydroxyl, –R" and —OR", wherein R"=$C_1$-$C_{20}$-alkyl, $C_2$-$C_{20}$-alkenyl, $C_1$-$C_{20}$-heterocycloalkyl, $C_6$-$C_{10}$-aryl, $C_6$-$C_{10}$-heteroaryl, (C═O)H, (C═O)—$C_1$-$C_{20}$-alkyl, (C═O)—$C_6$-$C_{10}$-aryl, (C═O)OH, (C═O)O—$C_1$-$C_{20}$-alkyl, (C═O)O—$C_6$-$C_{10}$-aryl, (C═O)$NH_2$, (C═O)NH($C_1$-$C_{20}$-alkyl), (C═O)NH($C_6$-$C_{10}$-aryl), (C═O)N($C_1$-$C_{20}$-alkyl)$_2$, (C═O)N($C_6$-$C_{10}$-aryl)$_2$, R" being optionally substituted by one or more functional groups E, wherein E independently represents a functional group selected from —F, —Cl, —Br, —I, —OH, —OR', —$NH_2$, —NHR', —N(R')$_2$, —N(R')$_3^+$, —C(O)R', —OC(O)R', —COOH, —$COO^-$ ($Na^+$, $K^+$), —COOR', —C(O)$NH_2$, —C(O)NHR', —C(O)N(R')$_2$, heteroaryl, —R', —SR', —SH, —P(R')$_2$, —P(O)(R')$_2$, —P(O)(OH)$_2$, —P(O)(OR')$_2$, —$NO_2$, —$SO_3H$, —$SO_3$—($Na^+$, $K^+$), —S(O)$_2$R', —NHC(O)R', and —N(R')C(O)R', wherein R' represents $C_6$-$C_{10}$-aryl, $C_7$-$C_{20}$-arylalkyl, or $C_1$-$C_{20}$-alkyl each of which may be each of which may be optionally substituted by —F, —Cl, —Br, —I, —$NH_3^+$, —$SO_3H$, —$SO_3^-$($Na^+$, $K^+$), —COOH, —$COO^-$($Na^+$, $K^+$), —P(O)(OH)$_2$, or —P(O)($O^-$($Na^+$, $K^+$))$_2$, and preferably each R independently represents hydrogen, $C_1$-$C_{40}$-alkyl or optionally $C_1$-$C_{20}$alkyl-substituted $C_6$-$C_{10}$-aryl, more preferably hydrogen or optionally substituted phenyl or naphthyl, or $C_{1-4}$-alkyl;

Y is a non-coordinating counterion;

a is an integer from 1 to 10, typically from 1 to 4;

k is an integer from 1 to 10;

n is an integer from 1 to 10, typically from 1 to 4; and m is zero or an integer from 1 to 20, and is typically an integer from 1 to 8.

As used herein, within the definitions provided above for formula (A1) and elsewhere, unless the context expressly dictates to the contrary, references to alkyl moieties, by which is meant saturated hydrocarbyl radicals, embrace alkyl groups that may comprising branched and/or cyclic portions. Likewise, references to alkenyl and alkynyl moieties embrace groups that may comprise branched and/or cyclic portions.

The counter ions Y in formula (A1) balance the charge z on the complex formed by the chelating ligand(s) L, metal ion(s) M and coordinating species X. According to this invention if the charge z is positive, and Y is anion such as $RCOO^-$, $BPh_4^-$, $ClO_4^-$, $BF_4^-$, $PF_6^-$, $RSO_3^-$, $RSO_4^-$, $SO_4^{2-}$, $NO_3^-$, $F^-$, $Cl^-$, $Br^-$, or $I^-$, with R being hydrogen, $C_1$-$C_{40}$-alkyl or optionally $C_1$-$C_{20}$alkyl-substituted $C_6$-$C_{10}$aryl. If the charge z is negative, then suitable counterions include alkali metal, alkaline earth metal or (alkyl)ammonium cation. Preferably, the charge z is positive, i.e. generally the transition metal ion-containing bleaching catalyst is a catalyst salt comprising one or more transition metal ions and one or more non-coordinating counteranions Y.

The identity of the counteranion(s) is not an essential feature of the invention. Suitable counter ions Y include those which give rise to the formation of storage-stable solids. Often counterions, including those for the preferred metal complexes, are selected from $Cl^-$, $Br^-$, $I^-$, $NO_3^-$, $ClO_4^-$, $PF_6^-$, $RSO_3^-$, $SO_4^{2-}$, $RSO_4^-$, $CF_3SO_3^-$, and $RCOO^-$, with R in this context being selected from H, $C_{1-12}$ alkyl, and optionally $C_{1-6}$alkyl-substituted $C_6H_5$ (i.e. wherein $C_6H_5$ is substituted one or more times (e.g. once) with a $C_{1-6}$alkyl group; often $C_6H_5$ is unsubstituted). Often, these will be selected from $Cl^-$, $NO_3^-$, $PF_6^-$, tosylate, $SO_4^{2-}$, $CF_3SO_3^-$, acetate, and benzoate. Particularly often, these will be selected from the group consisting of $Cl^-$, $NO_3^-$, $SO_4^{2-}$ and acetate.

Typically, transition metal ion-containing complexes contain transition metal ions selected from Mn(II), Mn(III), Mn(IV), Mn(V), Fe(II), Fe(III), or Fe(IV).

The transition metal ion-containing bleaching catalyst according to formula (A1) typically comprises, as chelating ligand(s) L, one or more tridentate, tetradentate, pentadentate, or hexadentate nitrogen donor ligands. It will be understood that the terms tridentate, tetradentate, pentadentate and hexadentate refer to the number of metal ion-binding donor atoms (in this case being nitrogen donor atoms) that can bind to a metal ion. For example, a tridentate nitrogen donor refers to an organic molecule that contains three nitrogen atoms with lone pairs, which can bind to a transition metal ion. These nitrogen donor atoms can be either an aliphatic nitrogen donor, either a tertiary, secondary or primary amine, or a nitrogen donor belonging an aromatic ring, for example pyridine. Whilst the name suggests that all nitrogen donors present in a ligand bind to a transition metal ion-containing complex, this need not necessarily be so. For example, when a ligand is a hexadentate nitrogen donor, it suggests that the ligand can bind with 6 nitrogen donor atoms, but it may only bind with 5 nitrogen donor atoms, leaving one coordination site open to bind to another molecule, such as the hydrogen peroxyl anion. This discussion presumes that a transition metal ion can bind to 6 donor atoms, which is generally, but not always, the case.

According to particular embodiments, the bleaching catalyst separate to the coated particles of or used according to the invention comprises a chelating ligand of formula (I):

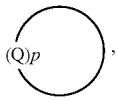

(I)

wherein:

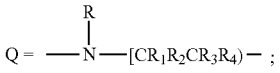

p is 3;

R is independently selected from the group consisting of hydrogen, $C_1$-$C_{24}$alkyl, $CH_2CH_2OH$, $CH_2COOH$, pyridin-2-ylmethyl and quinolin-2-ylmethyl; or one R is linked to the nitrogen atom of another Q of another ring of formula (I) via a $C_2$-$C_6$ alkylene bridge, a $C_6$-$C_{10}$ arylene bridge or a bridge comprising one or two $C_1$-$C_3$ alkylene units and one $C_6$-$C_{10}$ arylene unit, which bridge may be optionally substituted one or more times with independently selected $C_1$-$C_{24}$ alkyl groups; and $R_1$, $R_2$, $R_3$, and $R_4$ are independently selected from H, $C_1$-$C_4$alkyl and $C_1$-$C_4$-alkylhydroxy.

Ligands of formula (I) form complexes with, for example, one or two manganese ions, which complexes may be, or constitute part of, the bleaching catalyst.

According to particular embodiments of the ligands of formula (I), wherein p=3, each R is independently selected from the group consisting of hydrogen, $C_1$-$C_{24}$alkyl, $CH_2CH_2OH$, $CH_2COOH$, pyridin-2-ylmethyl and quinolin-2-ylmethyl; or one R is linked to the nitrogen atom of another Q of another ring of formula (I) via an ethylene or a propylene bridge. According to other particular embodiments of these ligands, each R is independently selected from the group consisting of hydrogen, $C_1$-$C_{24}$alkyl, $CH_2CH_2OH$ and $CH_2COOH$; or one R is linked to the nitrogen atom of another Q of another ring of formula (I) via an ethylene or a propylene bridge. According to other embodiments, each R of these ligands is independently selected from the group consisting of hydrogen, $C_1$-$C_6$alkyl, $CH_2CH_2OH$ and $CH_2COOH$; or one R is linked to the nitrogen atom of another Q of another ring of formula (I) via an ethylene or a propylene bridge. According to other embodiments, R is independently selected from the group consisting of hydrogen, $C_1$-$C_{24}$alkyl, $CH_2CH_2OH$ and $CH_2COOH$; or one R is linked to the nitrogen atom of another Q of another ring of formula (I) via an ethylene or a propylene bridge. According to other embodiments of these ligands, each R is independently selected from: hydrogen, $CH_3$, $C_2H_5$, $CH_2CH_2OH$ and $CH_2COOH$. According to still other embodiments, each R is independently selected from the group consisting of $C_1$-$C_6$alkyl, in particular methyl; or one R is linked to the nitrogen atom of another Q of another ring of formula (I) via an ethylene or a propylene bridge. Where one R is linked to the nitrogen atom of another Q of another ring of formula (I), this is typically via an ethylene bridge. In such embodiments, the other R groups, including those in the other ring of formula (I), are the same, typically $C_1$-$C_6$alkyl, in particular methyl.

According to further particular embodiments of the ligands of formula (I), wherein p=3, including each of those particular embodiments described in the immediately preceding paragraph, $R_1$, $R_2$, $R_3$, and $R_4$ are independently selected from hydrogen and methyl, in particular embodiments in which each of $R_1$, $R_2$, $R_3$, and $R_4$ is hydrogen.

When a ligand of formula (I), wherein p=3, comprises one group R linked to the nitrogen atom (i.e. N) of another Q of another ring of formula (I) via a bridge, it will be understood that such ligands, in particular embodiments comprising an ethylene bridge, may alternatively be represented by the following structure:

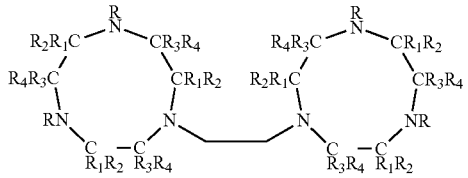

wherein R, $R_1$, $R_2$, $R_3$, and $R_4$ are as herein defined, including the various specific embodiments set out.

Where a bridge is present in the ligands of formula (I) this may be a $C_2$-$C_6$ alkylene bridge. Such alkylene bridges are typically although not necessarily straight chain alkylene bridges as discussed below. They may, however, be cyclic alkylene groups (e.g. the bridge may be cyclohexylene). Where the bridge is a $C_6$-$C_{10}$ arylene bridge, this may be, for example, phenylene or the corresponding arylene formed by abstraction of two hydrogen atoms from naphthalene. Where the bridge comprises one or two $C_1$-$C_3$ alkylene units and one $C_6$-$C_{10}$ arylene unit, such bridges may be, for example, —$CH_2C_6H_4CH_2$— or —$CH_2C_6H_4$—. It will be understood that each of these bridges may be optionally substituted one or more times, for example once, with independently selected $C_1$-$C_{24}$ alkyl (e.g. $C_1$-$C_{18}$ alkyl) groups.

In the ligands of formula (I), the bridge is typically a $C_2$-$C_6$ alkylene bridge. Where this is so, the bridge is typically a straight chain alkylene, e.g. is ethylene, n-propylene, n-butylene, n-pentylene or n-hexylene. According to particular embodiments, the $C_2$-$C_6$ alkylene bridge is ethylene or n-propylene. According to still more particular embodiments, the $C_2$-$C_6$ alkylene bridge is ethylene. Herein, references to propylene are intended to refer to n-propylene (i.e. —$CH_2CH_2CH_2$—, rather than —$CH(CH_3)CH_2$—) unless the context expressly indicates to the contrary.

According to particular embodiments of the invention, the ligand of formula (I) is 1,4,7-trimethyl-1,4,7-triazacyclononane ($Me_3$-TACN) or 1,2-bis(4,7-dimethyl-1,4,7-triazacyclonon-1-yl)-ethane ($Me_4$-DTNE).

Examples of catalysts of formula (I) include mononuclear complexes comprising one coordinating ligand of formula (I). Examples of dinuclear complexes may comprise either two coordinating ligands of formula (I), or one coordinating ligand of formula (I) where this comprises one group R linked to the nitrogen atom of another Q of another ring of formula (I) via a bridge, as described herein, e.g. is $Me_4$-DTNE.

Additionally, both mononuclear and dinuclear complexes comprise additional coordinating ligands (X). For dinuclear complexes, these are typically oxide ($O^{2-}$) or $C_{1-6}$carboxylate (i.e. $RCO_2^-$ wherein R is an alkyl group) ions, which bridge the two (typically manganese) ions. Where present, an alkylcarboxylate ion is typically acetate. Typically, dinuclear complexes comprise two or three bridging oxide ions. For example, dinuclear manganese ion-containing complexes may comprise two oxide ions and one acetate ion, each of which bridges the two manganese ions; or three oxide ions, each of which bridges the two manganese ions.

According to particular embodiments of all aspects of the present invention, the invention contemplates that the bleaching catalyst may comprise a dinuclear manganese ion-containing complex comprising two ligands of formula (I), where p=3, which do not comprise one group R linked to the nitrogen atom of another Q of another ring of formula (I) via a bridge, for example $Me_3$-TACN, in which the manganese ions are bridged by three oxide ions. According to particular embodiments, such complexes comprise two Mn (IV) ions. For example, the bleaching catalyst may comprise the complex $[Mn^{IV}Mn^{IV}(\mu\text{-}O)_3(Me_3\text{-}TACN)_2]^{2+}$, "μ" denoting, according to convention, a bridging ligand.

According to other particular embodiments of all aspects of the invention, the invention contemplates that the bleaching catalyst may comprise a dinuclear manganese ion-containing complex comprising one ligand of formula (I), where p=3, which does comprises one group R linked to the nitrogen atom of another Q of another ring of formula (I) via a bridge, for example $Me_4$-DTNE, in which the manganese ions are bridged by two oxide ions and one acetate ion. According to particular embodiments, such complexes comprise one Mn (IV) ion and one Mn (III) ion. For example, the bleaching catalyst may comprise the complex $[Mn^{III}Mn^{IV}(\mu\text{-}O)_2(\mu\text{-}CH_3COO)(Me_4\text{-}DTNE)]^{2+}$, which contains two bridging $O^{2-}$ and one bridging acetate group.

Typically, the complex $[M_aL_kX_n]$ of formula (A1), for example a mononuclear or dinuclear manganese ion-containing complexes described herein, have an overall positive charge, which is balanced by one or more non-coordinating counteranions Y. The identity of the counteranion(s) is not an essential feature of the invention. However, these will typically be selected from $Cl^-$, $Br^-$, $I^-$, $NO_3^-$, $ClO_4^-$, $PF_6^-$, $RSO_3^-$, $SO_4^{2-}$, $RSO_4^-$, $CF_3SO_3^-$, and $RCOO^-$, with R in this context being selected from H, $C_{1-12}$ alkyl, and optionally $C_{1-6}$alkyl-substituted $C_6H_5$ (i.e. wherein $C_6H_5$ is substituted one or more times (e.g. once) with a $C_{1-6}$alkyl group; often $C_6H_5$ is unsubstituted). Often, these will be selected from $Cl^-$, $NO_3^-$, $PF_6^-$, tosylate, $SO_4^{2-}$, $CF_3SO_3^-$, acetate, and benzoate. Particularly often, these will be selected from the group consisting of $Cl^-$, $NO_3^-$, $SO_4^{2-}$ and acetate.

Transition metal catalyst salts having significant water-solubility, such as at least 30 g/l at 20° C., e.g. at least 50 g/l at 20° C. or at least 70 g/l at 20° C., are described in WO 2006/125517 A1. On account of their high water solubility, the use of such salts, for example those comprising small counterions such as chloride, nitrate, sulfate and acetate, can be advantageous. Nevertheless, the $PF_6$ salt of $[Mn^{IV}Mn^{IV}(\mu\text{-}O)_3(Me_3\text{-}TACN)_2]^{2+}$ (which has a water solubility of 10.8 g/l at 20° C.) has been commercialised in laundry detergent powders and dishwashing tablets. Accordingly, this specific bleaching catalyst salt is contemplated according to specific embodiments of all aspects of the present invention. Also, catalyst salts comprising the tosylate anion, such as those described in WO 2011/066934 A1 and WO 2011/066935 A1 (both Clariant International Ltd) are also contemplated according to specific embodiments of the aspects of the present invention.

Alternatively, in the ligand of formula (I) depicted above:

each -Q- is independently selected from —$N(R)C(R_1)(R_2)C(R_3)(R_4)$— and —$N(R)C(R_1)(R_2)C(R_3)(R_4)\ C(R_5)(R_6)$—; and p is 4, wherein:

each R is independently selected from: hydrogen; $C_1$-$C_{20}$alkyl; $C_2$-$C_{20}$alkenyl; $C_2$-$C_{20}$alkynyl; $C_6$-$C_{10}$aryl, $C_7$-$C_{20}$arylalkyl, each of which may be optionally substituted with $C_1$-$C_6$alkyl; $CH_2CH_2OH$; $CH_2CO_2H$; and pyridin-2-ylmethyl; or two R groups of non-adjacent Q groups form a bridge, typically an ethylene bridge, linking the nitrogen atoms to which the bridge is attached;

$R_1$-$R_6$ are independently selected from: H, $C_{1-4}$alkyl and $C_{1-4}$alkylhydroxy.

Typical ligands of formula (I) wherein p is 4 comprise optionally $C_1$-$C_{20}$alkyl- or $C_6$-$C_{10}$aryl-substituted tetraaza-1,4,7,10-cyclododecane and tetraaza-1,4,8,11-cyclotetradecane. For example, an example of an optionally substituted tetraaza-1,4,8,11-cyclotetradecane is a ligand of the following formula:

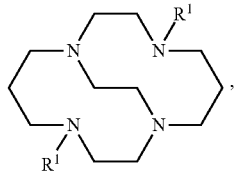

wherein $R^1$ is independently selected from hydrogen; $C_1$-$C_{20}$alkyl; $C_2$-$C_{20}$alkenyl; $C_2$-$C_{20}$alkynyl; or $C_6$-$C_{10}$aryl, $C_7$-$C_{20}$arylalkyl, each of which may be optionally substituted with $C_1$-$C_6$alkyl. For this class of ligands, the transition metal ion of the bleaching catalyst is typically Mn(II), Mn(III) and Mn(IV). Typically $R^1$ is methyl, ethyl or benzyl, often methyl. Other suitable cross-bridged ligands (so-called because of the presence of a bridge linking two non-adjacent nitrogen atoms of the tetrazacycloalkane) are described in WO 98/39098 (The University of Kansas).

Alternatively, the ligand L of formula (A1) may be of the following formula:

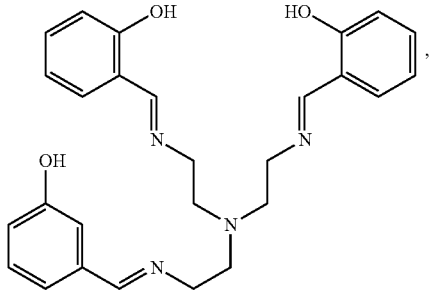

or an optionally substituted derivative thereof, wherein each of the four unsubstituted carbon atoms of each of the three phenyl moieties depicted may be independently optionally substituted with a substituent independently selected from the group consisting of cyano; halo; OR; COOR; nitro; linear or branched $C_{1-8}$alkyl; linear or branched partially fluorinated or perfluorinated $C_{1-8}$alkyl; NR'R"; linear or branched $C_{1-8}$alkyl-R'", wherein —R'" is —$NH_2$, —OR, —COOR or —NR'R"; or —$CH_2N^+RR'R''$ or —$N^+RR'R''$, wherein each R is independently hydrogen or linear or branched $C_{1-4}$alkyl; and each R' and R" is independently hydrogen or linear or branched $C_{1-12}$alkyl. Thus, for example, the structure depicted immediately above may be unsubstituted or substituted. Where substituted, one, two or three, for example, of each of the unsubstituted carbon atoms of the three phenyl moieties depicted may be independently substituted with the immediately aforementioned list of substituents. Bleaching catalysts comprising such ligands have been described in, for example, WO 02/02571 and WO 01/05925.

Alternatively, the ligand L of formula (A1) may be of the following formula:

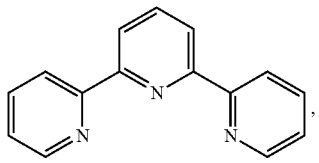

or an optionally substituted derivative thereof, wherein each of the hydrogen atoms attached to the eleven non-quaternary carbon atoms depicted may independently be optionally substituted by a substituent as defined for $R_1$-$R_{11}$ in claims 1 or 5 of WO 2010/020583 A1. Such ligands are known as terpy ligands. For example, each of these hydrogen atoms may be independently substituted with the following group of substituents: unsubstituted or substituted $C_{1-18}$alkyl or aryl; cyano; halogen; nitro; —$COOR_{12}$ or —$SO_3R_{12}$ wherein $R_{12}$ is in each case hydrogen, a cation or unsubstituted or substituted $C_{1-18}$alkyl or aryl; —$SR_{13}$, —$SO_2R_{13}$ or —$OR_{13}$ wherein $R_{13}$ is in each case hydrogen or unsubstituted or substituted $C_{1-18}$alkyl or aryl; —$NR_{14}R_{15}$, —($C_{1-6}$alkylene)$NR_{14}R_{15}$, —$N^+R_{14}R_{15}R_{16}$, —($C_{1-6}$alkylene)$N^+R_{14}R_{15}R_{16}$, —$N(R_{13})$($C_{1-6}$alkylene)$NR_{14}R_{15}$, —N[($C_{1-6}$alkylene)$NR_{14}R_{15}]_2$, —$N(R_{13})$($C_{1-6}$alkylene)$NR_{14}R_{15}RR_{16}$, —N[($C_{1-6}$alkylene)$N^+R_{14}R_{15}R_{16}]_2$, —$N(R_{13})NR_{14}R_{15}$ and —$N(R_{13})N^+R_{14}R_{15}R_{16}$, wherein $R_{13}$ is as defined above and $R_{14}$, $R_{15}$ and $R_{16}$ are each independently of the other(s) hydrogen or unsubstituted or substituted $C_{1-18}$alkyl or aryl, or $R_{14}$ and $R_{15}$ together with the nitrogen atom bonding them form an unsubstituted or substituted 5-, 6- or 7-membered ring which may optionally contain further heteroatoms; and a group of any of the following formulae:

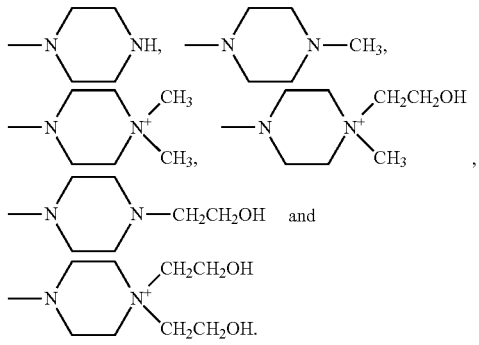

Bleaching catalysts comprising terpy ligands have been described in, for example, WO 02/088289, WO 2005/068074 and 2010/020583 A1.

In the terpy ligands described herein:

$C_{1-18}$alkyl radicals may be straight-chain or branched, such as methyl, ethyl, n-propyl, isopropyl, n-butyl, sec-butyl, isobutyl, tert-butyl or straight-chain or branched pentyl, hexyl, heptyl or octyl. Such alkyl radicals are often $C_{1-12}$alkyl radicals, for example $C_{1-8}$alkyl radicals such as $C_{1-4}$alkyl radicals. Alkyl radicals can be unsubstituted or substituted, e.g. by hydroxyl, $C_{1-4}$alkoxy, sulfo or by sulfato, especially by hydroxyl. Often, alkyl radicals are unsubstituted, for example are methyl or ethyl, e.g. methyl;

aryl radicals are typically phenyl or naphthyl (often phenyl) unsubstituted or substituted by $C_{1-4}$alkyl, $C_{1-4}$alkoxy, halogen, cyano, nitro, carboxyl, sulfo, hydroxyl, amino, N-mono- or N,N-di-$C_{1-4}$alkylamino, either unsubstituted or substituted by hydroxy in the alkyl moiety, N-phenylamino, N-naphthylamino, where the amino groups may be quaternized, phenyl, phenoxy or by naphthoxy. Typical substituents are $C_{1-4}$alkyl, $C_{1-4}$alkoxy, phenyl and hydroxy;

$C_{1-6}$alkylene groups may be straight-chain or branched alkylene radicals such as methylene, ethylene, n-propylene or n-butylene. Alkylene radicals may be unsubstituted or substituted, for example by hydroxyl or $C_{1-4}$alkoxy;

$R_{12}$ is typically hydrogen, a cation, $C_{1-12}$alkyl, or phenyl unsubstituted or substituted as defined above. $R_{12}$ is often hydrogen, an alkali metal or alkaline earth metal cation or an ammonium cation, $C_{1-4}$alkyl or phenyl, typically hydrogen or an alkali metal cation, alkaline earth metal cation or ammonium cation. Examples of suitable cations are alkali metal cations, such as lithium, potassium and sodium; alkaline earth metal cations such as magnesium and calcium; and ammonium cations. Often, cations are alkali metal cations, for example sodium;

$R_{13}$ is typically hydrogen, $C_{1-12}$alkyl, or phenyl unsubstituted or substituted as defined above. $R_{13}$ is often hydrogen, $C_{1-4}$alkyl or phenyl, for example hydrogen or $C_{1-4}$alkyl, e.g. hydrogen. Examples of the radical of formula —$OR_{13}$ include hydroxyl and $C_{1-4}$alkoxy, such as methoxy and, in particular, ethoxy; and when $R_{14}$ and $R_{15}$ together with the nitrogen atom bonding them form a 5-, 6- or 7-membered ring this is preferably an unsubstituted or $C_{1-4}$alkyl-substituted pyrrolidine, piperidine, piperazine, morpholine or azepane ring, where the amino groups can optionally be quaternized. Typically where an amino group in a 5-, 6- or 7-membered ring is quaternized, it is not one of the nitrogen atoms of these rings directly bonded to one of the three mandatory pyridine groups of the terpy ligands. If present, a piperazine ring can be substituted by one or two unsubstituted $C_{1-4}$alkyl and/or substituted $C_{1-4}$alkyl groups, for example at the nitrogen atom not directly bonded to one of the three mandatory pyridine groups of the terpy ligands. In addition, $R_{14}$, $R_{15}$ and $R_{16}$ are typically hydrogen, unsubstituted or hydroxyl-substituted $C_{1-12}$alkyl, or phenyl unsubstituted or substituted as defined above. Often, each of $R_{14}$, $R_{15}$ and $R_{16}$ is selected from hydrogen, unsubstituted or hydroxyl-substituted $C_{1-4}$alkyl or phenyl, for example hydrogen or unsubstituted or hydroxyl-substituted $C_{1-4}$alkyl, e.g. hydrogen.

Often, terpy ligands are of the following formula:

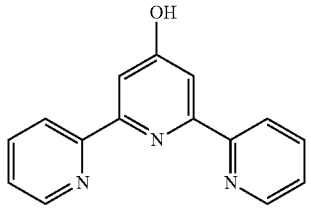

or an optionally substituted derivative thereof, wherein each of the hydrogen atoms attached to the ten non-quaternary carbon atoms depicted may independently be optionally substituted as described hereinbefore.

According to further embodiments, the ligand of the bleaching catalyst of formula (A1), particularly where M is an iron ion, in particular Fe(II) or Fe(III), is of formula (II):

(II)

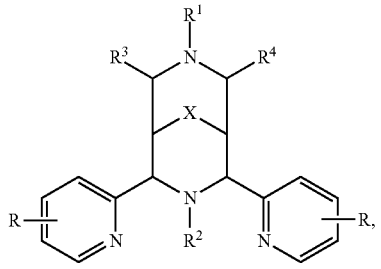

wherein:

each R is independently selected from hydrogen and C1-4-alkyl;

—$R^1$ and —$R^2$ are independently selected from —$C_{1-24}$alkyl; —$C_{6-10}$aryl; —$C_{2-4}$alkylene-$NR^6R^7$, wherein the $C_2$-4alkylene group is optionally substituted by 1 to 4 methyl or ethyl groups, or may be part of a $C_{3-6}$cycloalkyl ring; and an optionally $C_{1-4}$alkyl-substituted pyridin-2-ylmethyl group;

$R^3$ and $R^4$ are —$CO_2CH_3$, —$CO_2CH_2CH_3$, —$CO_2CH_2C_6H_5$ and $CH_2OH$;

each —$NR^6R^7$ if present is independently selected from the group consisting of di($C_{1-44}$alkyl)amino; di($C_{6-10}$aryl) amino wherein the aryl groups are each optionally substituted with one or more, typically one, $C_{1-20}$alkyl groups; di($C_{6-10}$aryl$C_{1-6}$alkyl)amino wherein the aryl groups are each optionally substituted with one or more, typically one, $C_{1-20}$alkyl groups (for example an example of a di($C_{6-10}$aryl$C_{1-4}$alkyl)amino is di(p-methylbenzyl)amino); heterocycloalkyl, for example pyrrolidinyl, piperidinyl or morpholinyl, optionally substituted with one or more, typically one, $C_{1-20}$alkyl groups; di(heterocycloalkyl$C_{1-6}$alkyl)amino, for example di(piperidinylethyl)amino, wherein the heterocycloalkyl groups are each optionally substituted with one or more, typically one, $C_{1-20}$alkyl groups; and di(heteroaryl $C_{1-6}$alkyl)amino, for example di(pyridin-2-ylethyl)amino, wherein the heteroaryl groups are each optionally substituted with one or more, typically one, $C_{1-20}$alkyl groups; and X is selected from C═O and —$[C(R8)_2]_y$— wherein y is from 0 to 3 and each R8 is independently selected from hydrogen, hydroxyl, C1-C4-alkoxy and C1-C4-alkyl.

Such ligands are known in the art as bispidons.

Preferably, each —$NR^6R^7$ if present is independently selected from the group consisting of $NMe_2$, —$NEt_2$, —N(i-Pr)$_2$,

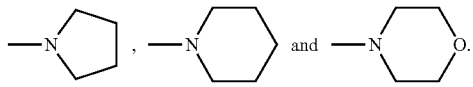

In formula (II), each R is typically hydrogen or $CH_3$ and X is C═O or $C(OH)_2$. Typical groups for —$R^1$ and —$R^2$ are —$CH_3$, —$C_2H_3$, —$C_3H_7$, -benzyl, —$C_4H_9$, —$C_6H_{13}$, —$C_8H_{17}$, —$C_{12}H_{25}$, —$C_{18}H_{37}$, pyridin-2-ylmethyl, and —$CR_2CR_2NR^6R^7$.

A preferred class of bispidons is one in which at least one of $R^1$ or $R^2$ is pyridin-2-ylmethyl or $C(R)_2C(R)_2NR^6R^7$ (wherein each, particularly wherein each R is independently hydrogen, methyl or ethyl). Within such bispidons, $NR^6R^7$ is preferably selected from —$NMe_2$, —$NEt_2$, —N(i-Pr)$_2$,

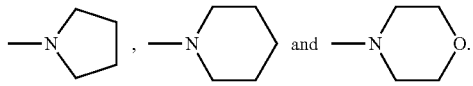

In particular embodiments of the immediately aforementioned bispidons, at least one $R^1$ or $R^2$ is $C(R)_2C(R)_2NR^6R^7$ in which one of the R groups is methyl or ethyl, in particular methyl. According to particular embodiments, the methyl or ethyl group is attached to the carbon atom beta to the $NR^6R^7$moiety, i.e. at least one $R^1$ or $R^2$ is C(R)(Me or Et)$C(R)_2NR^6R^7$.

A particular preferred bispidon is dimethyl 2,4-di-(2-pyridyl)-3-methyl-7-(pyridin-2-ylmethyl)-3,7-diaza-bicyclo[3.3.1]nonan-9-one-1,5-dicarboxylate (N2py3o-C1) and the iron complex thereof (FeN2py3o-C1) which is described in WO 02/48301. Another particular preferred bispidon is dimethyl 9,9-dihydroxy-3-methyl-2,4-di-(2-pyridyl)-7-(1-(N,N-dimethylamine)-eth-2-yl)-3,7-diaza-bicyclo[3.3.1]nonane-1,5-dicarboxylate and the iron complex thereof as described in WO 03/104234.

Other preferred bispidons are those that have instead of having $R^1$=methyl, as for example in the preferred compound dimethyl 2,4-di-(2-pyridyl)-3-methyl-7-(pyridin-2-ylmethyl)-3,7-diaza-bicyclo[3.3.1]nonan-9-one-1,5-dicarboxylate (N2py3o-C1), other N-alkyl groups are present, for example isobutyl, (n-hexyl) C6, (n-octyl) C8, (n-dodecyl) C12, (n-tetradecyl) C14, (n-octadecyl) C18. Examples of such bispidons are described in WO 02/48301, WO 03/104379 and WO 2005/049778.

A further class of transition metal ion-containing bleaching catalysts comprise ligands of formula (III), typically as iron ion-containing complexes:

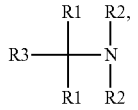

(III)

wherein:

each R1 represents pyridine-2-yl;

each R2 represents pyridine-2-ylmethyl; and

R3 represents hydrogen; a $C_1$-$C_{40}$-alkyl; or a $C_6$-$C_{10}$-aryl or $C_7$-$C_{20}$-arylalkyl either of which may be optionally substituted with a $C_1$-$C_{20}$-alkyl group.

Exemplary ligands of formula (III) are N,N-bis(pyridin-2-yl-methyl)-bis(pyridin-2-yl)methylamine (N4Py), which is disclosed in WO 95/34628; and N,N-bis(pyridin-2-yl-methyl-1,1-bis(pyridin-2-yl)-1-aminoethane (MeN4py), as disclosed in EP 0 909 809.

A still further class of ligands are the so-called trispicen ligands. The trispicens are generally in the form of an iron ion-containing bleaching catalyst. The trispicen ligands are preferably of the formula (IV):

R17R17N—X—NR17R17 (IV), wherein:

X is selected from —$CH_2CH_2$—, —$CH_2CH_2CH_2$—, —$CH_2C(OH)HCH_2$—;

each R17 independently represents a group selected from: $C_1$-$C_{20}$-alkyl, $C_1$-$C_{20}$-heterocycloalkyl, $C_3$-$C_{10}$-heteroaryl, $C_6$-$C_{10}$-aryl and $C_1$-$C_{20}$-arylalkyl groups, each of which may be optionally substituted with a substituent selected from hydroxy, $C_1$-$C_{20}$-alkoxy, phenoxy, $C_1$-$C_{20}$-carboxylate, $C_1$-$C_{20}$-carboxamide, $C_1$-$C_{20}$-carboxylic ester, sulfonate, amine, $C_1$-$C_{20}$-alkylamine, NH($C_1$-$C_{20}$-alkyl), N($C_1$-$C_{20}$-alkyl)$_2$, and $N^+(R19)_3$, wherein R19 is selected from hydrogen, $C_1$-$C_{20}$-alkyl, $C_2$-$C_{20}$-alkenyl, $C_1$-$C_{20}$-arylalkyl, $C_1$-$C_{20}$-arylalkenyl, oxy-$C_1$-$C_{20}$-alkyl, oxy-$C_1$-$C_{20}$-alkenyl, amino-$C_1$-$C_{20}$-alkyl, amino-$C_1$-$C_{20}$-alkenyl, $C_1$-$C_{20}$-alkyl ether, $C_1$-$C_{20}$-alkenyl ether, and —$CY_2$—R18, in which each Y is independently selected from H, $CH_3$, $C_2H_5$, $C_3H_7$ and R18 is independently selected from an optionally $C_1$-$C_{20}$alkyl-substituted heteroaryl group selected from pyridinyl, pyrazinyl, pyrazolyl, pyrrolyl, imidazolyl, benzimidazolyl, pyrimidinyl, triazolyl and thiazolyl; and at least two of R17 are —$CY_2$—R18.

The optionally $C_1$-$C_{20}$-alkyl substituted heteroaryl group is preferably pyridinyl, e.g. 2-pyridinyl, optionally substituted by —$C_1$-$C_4$-alkyl.

Other preferred optionally $C_1$-$C_{20}$-alkyl substituted heteroaryl groups include imidazol-2-yl, 1-methyl-imidazol-2-yl, 4-methyl-imidazol-2-yl, imidazol-4-yl, 2-methyl-imidazol-4-yl, 1-methyl-imidazol-4-yl, benzimidazol-2-yl and 1-methyl-benzimidazol-2-yl.

Preferably three or four of R17 are $CY_2$—R18.

The ligand Tpen (N,N,N',N'-tetra(pyridin-2-yl-methyl) ethylenediamine) is described in WO 97/48787. Other suitable trispicens are described in WO 02/077145 and EP 1 001 009 A. Further examples of trispicens are described in WO 00/12667, WO2008/003652, WO 2005/049778, EP 2 228 429 and EP 1 008 645.

According to particular embodiments of the methods and use of the present invention, bleaching formulations may be used for bleaching and/or modifying (e.g. degrading) polysaccharides (for example cellulose or starch) or polysaccharide-containing (for example cellulose-containing, also referred to herein as cellulosic) substrates. Cellulosic substrates are found widely in domestic, industrial and institutional laundry, wood-pulp, cotton processing industries and the like. For example, raw cotton (gin output) is dark brown in colour owing to the natural pigment in the plant. The cotton and textile industries recognise a need for bleaching cotton prior to its use in textiles and other areas. The object of bleaching such cotton fibres is to remove natural and adventitious impurities with the concurrent production of substantially whiter material.

Irrespective of the nature of the substrate treated in accordance with the methods or use of the invention, it is the objective when doing so to effect bleaching, i.e. to remove unwanted chromophores (be they, for example, stains or solids on cloth in laundering or residual lignin in wood pulp or polyphenolic materials present in raw cotton and wood pulp and paper) and/or to degrade material generally. According to particular embodiments, therefore, the substrate may be a polysaccharide- or polysaccharide-containing substrate, for example wherein the polysaccharide is a cellulosic substrate, such as cotton, wood pulp, paper or starch.

An embodiment of the methods and use of the invention is or relates to a method of cleaning textiles or non-woven fabrics, typically textiles. By textile is meant herein a woven or knitted fabric, that is to say a fabric with interlacing fibres resultant from weaving, knotting, crocheting or knitting together natural or artificial fibres. As is known in the art, textiles are distinguished by virtue of their method of manufacture from non-woven fabrics, which are also made of fibrous material and produced through bonding achieved by application of heat, mechanical pressure or chemical (including solvent) treatment. Accordingly, embodiments of methods of the invention include methods of cleaning textiles or non-woven fabrics, typically in a mechanical washing machine, which comprise contacting a textile or non-woven fabric with water and a bleaching formulation in accordance with the third aspect of the invention.

The methods and use of the invention may also be or relate to a method of bleaching and/or modifying (e.g. degrading) a compound generally, for example a cellulosic material or a polysaccharide or polysaccharide-containing material (e.g. starch). The cellulosic material may be, for example, cotton, wood pulp or paper. Accordingly, embodiments of the methods or use of the invention include or relate to methods of bleaching and/or modifying (e.g. degrading) such a material, which comprise contacting the material with water and a bleaching formulation.

The method of the third aspect of the invention is characterised in that the temperature of the mixture resultant from the contacting is set to be no higher than that at which the coating melts. Often, in applications in which bleaching formulations are used, for example in machine-based cleaning of textiles, a program is selected on the machine to control the temperature regime throughout the cleaning. This is an example of what is meant by the temperature being set. For example, a program may be selected so that cleaning is intended to be effected at a temperature of about 40° C. If the temperature during cleaning is maintained in accordance with this setting, in the presence of a bleaching formulation comprising coated particles as described herein in which the coating melts at, for example, about 50° C., then the coating will not melt and the cleaning will proceed as normal. On the other hand, if the machine malfunctions, for example, and the temperature increases to 60° C., the coating will melt, releasing the contents of the coated particles' cores whereby to ameliorate the detrimental effect to the textile caused by the undesired high temperature.

The method of the fourth aspect of the invention is complementary to that of the third aspect of the invention and does not require that the temperature of the mixture resultant from the contacting is set to be no higher than that at which the coating melts. Often, in applications in which bleaching formulations are used, for example in machine-based cleaning of textiles, a program (typically one involving heating to too high a temperature) unsuitable bleaching catalyst present in the bleaching formulation is selected, perhaps inadvertently, on the machine. For example, a program may be selected so that cleaning is intended to be effected at a temperature of about 60° C. or higher. At temperatures below this, which will typically prevail initially, in the presence of a bleaching formulation comprising coated particles as described herein in which the coating melts at, for example, about 50° C., then the coating will not melt and the cleaning will proceed as intended by the manufacturer of the bleaching formulation. On the other hand, once the temperature increases to 60° C., for example, the coating will melt, releasing the contents of the coated particles' cores whereby to ameliorate the detrimental effect to the textile caused by user's selection of an unsuitably high temperature.

In addition to a peroxy compound, or a bleaching system comprising a peroxy compound and a peroxycarboxylic acid precursor, such as TAED or NOBS, a typical bleaching formulation comprises other components which depend on the purpose for which the formulation is intended.

According to particular embodiments of the invention, the bleaching formulations described herein are suitable for use, and may be used in, methods of cleaning textiles or non-woven fabrics, in particular methods of cleaning fabric, i.e. textiles or non-woven fabrics, for example clothes. Although it is to be understood that the invention is not to be considered to be so limited, where a bleaching formulation is intended for use in laundry applications, the bleaching formulation will typically comprise other components well understood by those of normal skill in the art, such as one or more surfactants, for example cationic anionic or non-anionic (amphiphilic) surfactants; bleach stabilisers (also known as sequestrants), for example organic sequestrants such as aminophosphonate or a carboxylate sequestrants; as well as other components, including (but not limited to) detergency builders, enzymes and perfuming agents.

Generally, it will be desirable to incorporate one or more surfactants into the bleaching formulations of the used according to the invention, typically in an amount of between about 0.1 and about 50 wt %. These are typically selected from anionic and non-ionic surfactants. Advantageously, where surfactants are included, these can serve to emulsify the coating material of the coated particles described herein, if or once it melts. Suitable nonionic and anionic surfactants may be chosen from the surfactants described in one or more of "Surface Active Agents" Vol. 1, by Schwartz & Perry, Interscience 1949 or Vol. 2 by Schwartz, Perry & Berch, Interscience 1958; the current edition of "McCutcheon's Emulsifiers and Detergents" published by Manufacturing Confectioners Company; and "Tenside-Taschenbuch", H. Stache, 2nd Edn., Carl Hauser Verlag, 1981. Examples of descriptions of suitable anionic and nonionic surfactants can for example be found in WO 03/072690 A1 (Unilever N.V. et al.), WO 02/068574 A1 (Unilever N.V. et al.) and WO 2012/048951 A1 (Unilever PLC et al.)

Suitable nonionic detergent compounds include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$-$C_{22}$ alkyl phenol-ethylene oxide condensates, generally 5 to 25 EO, i.e. 5 to 25 units of ethylene oxide per molecule, and the condensation products of aliphatic $C_8$-$C_{18}$ primary or secondary linear or branched alcohols with ethylene oxide, generally 5 to 40 EO. Suitable anionic detergent compounds which may be used are usually water-soluble alkali metal salts of organic sulfates and sulfonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulfates, especially those obtained by sulfating higher $C_8$-$C_{18}$ alcohols, produced for example from tallow or coconut oil, sodium and potassium alkyl $C_9$-$C_{20}$ benzene sulfonates, particularly sodium linear secondary alkyl C10-$C_{15}$ benzene sulfonates; and sodium alkyl glyceryl ether sulfates, especially those ethers of the higher alcohols derived from tallow or coconut oil and synthetic alcohols derived from petroleum.

Typical anionic detergent compounds are sodium $C_{11}$-$C_{15}$ alkyl benzene sulfonates and sodium $C_{12}$-$C_{18}$ alkyl sulfates. Also applicable are surfactants such as those described in EP-A-328 177, which show resistance to salting-out, the alkyl polyglycoside surfactants described in EP-A-070 074, and alkyl monoglycosides.

Typically, more than one type of surfactant is included. Preferred surfactant systems are mixtures of anionic with nonionic detergent active materials, in particular the groups and examples of anionic and nonionic surfactants pointed out in EP-A-346 995. Especially preferred is a surfactant system that is a mixture of an alkali metal salt of a $C_{16}$-$C_{18}$ primary alcohol sulfate together with a $C_{12}$-$C_{15}$ primary alcohol 3-7 EO ethoxylate.

Where present, a nonionic detergent (i.e. surfactant) is typically present in an amount of greater than 10%, e.g. 25-100% by weight of the surfactant system (i.e. the total weight of surfactants present in the bleaching formulation). Anionic surfactants may be present in amounts in the range from about 0% to 100% by weight of the surfactant system, with the proviso that the relative wt-% of the anionic and non-ionic surfactant is equal or less than 100 wt-%.

The bleaching formulation may take any conventional physical form, such as a powder, granular composition, tablets, a paste or an anhydrous gel.

The bleaching formulation and used according to the present invention may additionally comprise one or more enzymes, which may provide cleaning performance, fabric care and/or sanitation benefits. The enzymes may include oxidoreductases, transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN 0-12-227165-3, Academic Press. Examples of suitable enzymes can be found for example in EP 1 678 286 A1.

Builders may also be present, for example, aluminosilicates, in particular zeolites, e.g. zeolite A, B, C, X and Y types, as well as zeolite MAP as described in EP 0 384 070 A; and precipitating builders such as sodium carbonate. Such builders are typically present in an amount from about 5 to about 80 wt-%, more preferably from about 10 to 50 wt-%, based on the solids content of the bleaching formulation. Builders, polymers and other enzymes as optional ingredients may also be present as described in WO 00/60045 and WO 2012/104159. Suitable detergency builders as optional ingredients include those described in WO 00/34427.

The skilled person will be readily able to formulate a suitable bleaching formulation for use in laundry in accordance with his normal skill. Likewise, the skilled person will be readily able to formulate bleaching formulations suitable for use in the other applications described herein. Such formulations may, for example, comprise additional metal-ion based or organic catalysts suitable for catalysing the activity of the peroxy compounds described herein. Non-limiting examples of transition metal-based bleaching catalysts can be found for example in EP 2 228 429 A1 (Unilever PLC and Unilever N.V.), and references cited therein and examples of organic catalysts can be found in WO 2012/071153 A1 (The Procter & Gamble Company).

Each and every patent and non-patent reference referred to herein is hereby incorporated by reference in its entirety, as if the entire contents of each reference were set forth herein in its entirety.

The invention may be further understood with reference to the following non-limiting clauses:

1. A bleaching formulation comprising one or more particles and, separately to the particles, a transition metal ion-containing bleaching catalyst, the particles comprising:

(i) a core comprising either an inorganic solid support material selected from the group consisting of clays, aluminium silicates, silicates, silicas, carbon black and activated carbon, or a catalase enzyme or a mimic thereof; and an amount of about 0 to about 10 wt % of a transition metal ion-containing bleaching catalyst, the amount of the catalyst being with respect to the weight of the core; and (ii) a coating encapsulating the core, which comprises a material that melts a temperature of between about 30° C. and about 90° C., with the proviso that, where the inorganic solid support material is talc or a clay, the core does not comprise a peroxy compound or source thereof or a catalase enzyme or mimic thereof.

2. The formulation of clause 1, which comprises between about 0.002 and 20 wt % of the inorganic solid support material.
3. The formulation of clause 1 or clause 2, wherein the inorganic solid support material is a clay.
4. The formulation of clause 3, wherein the clay is a smectite clay.
5. The formulation of clause 4, wherein the clay is a montmorillonite or hectorite
6. The formulation of clause 5, wherein the clay is a montmorillonite.
7. The formulation of clause 6, wherein the clay is bentonite.
8. The formulation of any one preceding clause, wherein the core comprises calcium carbonate- and/or zeolite-supported catalase.
9. The formulation of any one preceding clause, wherein the core consists essentially of an inorganic solid support material and/or a catalase enzyme or mimic thereof.
10. The formulation of any one preceding clause, wherein there is no transition metal ion-containing bleaching catalyst in the core.
11. The formulation of any one preceding clause, wherein there is no peroxy compound or source thereof, or catalase enzyme or mimic thereof, in the core.
12. The formulation of any one preceding clause, wherein the catalyst separate to the particles comprises one or more transition metal ions selected from the group consisting of Mn(II), Mn(III), Mn(IV), Mn(V), Fe(II), Fe(III) and Fe(IV).
13. The formulation of clause 12, wherein the one or more transition metal ions are selected from the group consisting of Mn(II), Mn(III), Mn(IV), Mn(V), for example from the group consisting of Mn(III) and Mn(IV).
14. The formulation of any one preceding clause, wherein the catalyst separate to the particles comprises a tridentate, tetradentate, pentadentate or hexadentate nitrogen donor ligand.
15. The formulation of any one of clauses 1 to 13, wherein the catalyst separate to the particles comprises a mononuclear or dinuclear complex comprising a ligand of formula (I):

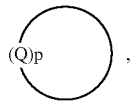

(I)

wherein:

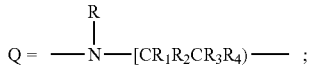

p is 3;

R is independently selected from the group consisting of hydrogen, $C_1$-$C_{24}$alkyl, $CH_2CH_2OH$ and $CH_2COOH$; or one R is linked to the nitrogen atom of another Q of another ring of formula (I) via a $C_2$-$C_6$ alkylene bridge, a $C_6$-$C_{10}$ arylene bridge or a bridge comprising one or two $C_1$-$C_3$ alkylene units and one $C_6$-$C_{10}$ arylene unit, which bridge may be optionally substituted one or more times with independently selected $C_1$-$C_{24}$ alkyl groups; and $R_1$, $R_2$, $R_3$, and $R_4$ are independently selected from H, $C_1$-$C_4$alkyl and $C_1$-$C_4$-alkylhydroxy.

16. The formulation of clause 15, wherein the complex comprises a Mn(III) and/or Mn(IV) ion.
17. The formulation of clause 15 or clause 16, wherein R is independently selected from the group consisting of hydrogen, $C_1$-$C_6$alkyl, $CH_2CH_2OH$ and $CH_2COOH$; or one R is linked to the nitrogen atom of another Q of another ring of formula (I) via an ethylene bridge.
18. The formulation of clause 17, wherein each R is independently selected from: $CH_3$, $C_2H_5$, $CH_2CH_2OH$ and $CH_2COOH$.
19. The formulation of clause 18, wherein $R_1$, $R_2$, $R_3$, and $R_4$ are independently selected from hydrogen and methyl.
20. The formulation of any one of clauses 15 to 19, wherein the catalyst separate to the particles comprises a dinuclear Mn (III) and/or Mn(IV) complex with at least one $O^{2-}$ bridge between the two manganese ions.
21. The formulation of any one of clauses 15 to 20, wherein the catalyst separate to the particles comprises 1,4,7-trimethyl-1,4,7-triazacyclononane ($Me_3$-TACN) or 1,2-bis(4,7-dimethyl-1,4,7-triazacyclonon-1-yl)-ethane ($Me_4$-DTNE).
22. The formulation of clause 21, wherein the catalyst separate to the particles comprises a transition metal ion-containing complex, which is $[Mn^{IV}Mn^{IV}(\mu\text{-}O)_3(Me_3\text{-}TACN)_2]^{2+}$ or $[Mn^{III}Mn^{IV}(\mu\text{-}O)_2(\mu\text{-}CH_3COO)(Me_4\text{-}DTNE)]^{2+}$.

23. The formulation of any one preceding clause, wherein the coating melts between about 30° C. and about 80° C.
24. The formulation of clause 21 or clause 22, wherein the catalyst separate to the particles comprises 1,2-bis(4,7-dimethyl-1,4,7-triazacyclonon-1-yl)ethane and the coating melts between about 50 and about 70° C.
25. The formulation of clause 21 or clause 22, wherein the catalyst separate to the particles comprises 1,4,7-trimethyl-1,4,7-triazacyclononane and the coating melts between about 30 and about 50° C.
26. The formulation of clause 25, wherein the coating melts between about 40 and about 50° C.
27. The formulation of any one of clauses 1 to 13, wherein the catalyst separate to the particles comprises a mononuclear or dinuclear complex comprising a ligand of formula (I):

(I)

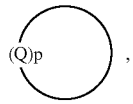

wherein:

each -Q- is independently selected from —N(R)C($R_1$)($R_2$)C($R_3$)($R_4$)— and —N(R)C($R_1$)($R_2$)C($R_3$)($R_4$) C($R_5$)($R_6$)—; and p is 4, wherein:

each R is independently selected from: hydrogen; $C_1$-$C_{20}$alkyl; $C_2$-$C_{20}$alkenyl; $C_2$-$C_{20}$alkynyl; $C_6$-$C_{10}$aryl, $C_7$-$C_{20}$arylalkyl, each of which may be optionally substituted with $C_1$-$C_6$alkyl; $CH_2CH_2OH$; $CH_2CO_2H$; and pyridin-2-ylmethyl; or two R groups of non-adjacent Q groups form a bridge, typically an ethylene bridge, linking the nitrogen atoms to which the bridge is attached;

$R_1$-$R_6$ are independently selected from: H, $C_{1-4}$alkyl and $C_{1-4}$alkylhydroxy.

28. The formulation of any one of clauses 1 to 13, wherein the catalyst separate to the particles comprises a ligand of the following formula:

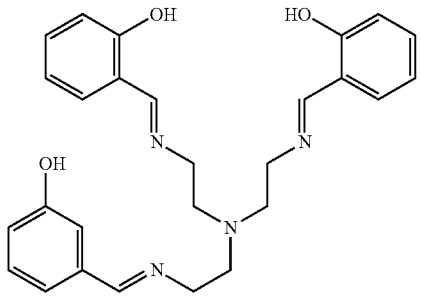

or an optionally substituted derivative thereof, wherein each of the four unsubstituted carbon atoms of each of the three phenyl moieties depicted may be independently optionally substituted with a substituent independently selected from the group consisting of cyano; halo; OR; COOR; nitro; linear or branched $C_{1-8}$alkyl; linear or branched partially fluorinated or perfluorinated $C_{1-8}$alkyl; NR'R"; linear or branched $C_{1-8}$alkyl-R'", wherein —R'" is —$NH_2$, —OR, —COOR or —NR'R"; or —$CH_2N^+$RR'R" or —$N^+$ RR'R", wherein each R is independently hydrogen or linear or branched $C_{1-4}$alkyl; and each R' and R" is independently hydrogen or linear or branched $C_{1-12}$alkyl.

29. The formulation of any one of clauses 1 to 13, wherein the catalyst separate to the particles comprises a ligand of the following formula:

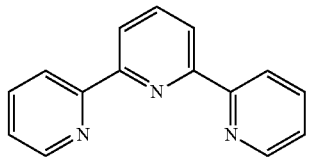

or an optionally substituted derivative thereof, wherein each of the hydrogen atoms attached to the eleven non-quaternary carbon atoms depicted may independently be optionally substituted by a substituent as defined for $R_1$-$R_{11}$ in claim 1 of WO 2010/020583 A1, for example a ligand of the following formula:

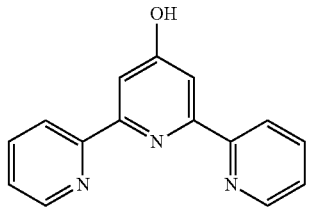

or an optionally substituted derivative thereof, wherein each of the hydrogen atoms attached to the ten non-quaternary carbon atoms depicted may independently be optionally substituted by a substituent as defined for $R_1$-$R_{11}$ in claim 1 of WO 2010/020583 A1.

30. The formulation of any one preceding clause, wherein the catalyst separate to the particles comprises one or more counterions that are not coordinated to a transition metal ion of the catalyst.
31. The formulation of clause 30, wherein the one or more non-coordinating counterions are selected from the group consisting of $Cl^-$, $Br^-$, $I^-$, $NO_3^-$, $ClO_4^-$, $PF_6^-$, $SO_4^{2-}$, $R^5SO_3^-$, $R^5SO_4^-$, $CF_3SO_3^-$ and $R^5COOO^-$, wherein $R^5$ is H, $C_{1-12}$alkyl and optionally $C_{1-6}$alkyl-substituted $C_6H_5$.
32. The formulation of clause 31, wherein the one or more non-coordinating counterions are selected from the group consisting of $Cl^-$, $NO_3^-$, $PF_6^-$, tosylate, $SO_4^{2-}$, $CF_3SO_3^-$, acetate and benzoate.
33. The formulation of clause 31, wherein the one or more non-coordinating counterions are selected from the group consisting of $Cl^-$, $NO_3^-$, $SO_4^{2-}$ and acetate.
34. The formulation of any one preceding clause, wherein the coating is formed from a paraffin wax, a fatty acid or a fatty acid soap.
35. The formulation of any one preceding clause, which further comprises a peroxy compound.
36. The formulation of clause 35, wherein the peroxy compound is an alkali metal perborate, an alkali metal percarbonate or hydrogen peroxide.
37. The formulation of clause 36, wherein the peroxy compound is an alkali metal percarbonate.
38. The formulation of any one preceding clause, which further comprises a surfactant.
39. A particle as defined in any one of clauses 1 to 34.

40. A method comprising contacting a substrate with water and a bleaching formulation, the bleaching formulation comprising one or more particles and, separately to the particles, a transition metal ion-containing bleaching catalyst salt, the particles comprising:

(i) a core comprising either an inorganic solid support material selected from the group consisting of clays, aluminium silicates, silicates, silicas, carbon black and activated carbon or a catalase enzyme or a mimic thereof; and an amount of about 0 to about 10 wt % of a transition metal ion-containing bleaching catalyst, the amount of the catalyst being with respect to the weight of the core; and (ii) a coating encapsulating the core, which comprises a material that melts at a temperature of between about 30° C. and about 90° C., characterised in that the temperature of the mixture resultant from the contacting is set to be no higher than that at which the coating material melts.

41. The method of clause 40, wherein the particles are as defined in any one of clauses 2 to 34, except for not being subject to the proviso of clause 1.
42. The method of clause 40, wherein the particles are as defined in any one of clauses 2 to 34.
43. A method comprising contacting a substrate with water and a bleaching formulation as defined in any one of clauses 1 to 38.
44. The method of any one of clauses 40 to 43, which is a method of cleaning a textiles or a non-woven fabric, the method comprising contacting the textile or the non-woven fabric with water and the bleaching formulation.
45. Use of a particle as defined in clause 40 to protect against damage to a cellulosic substrate contacted with water and a bleaching formulation comprising a transition metal ion-containing bleaching catalyst.
46. The use of clause 45, wherein the particles are as defined in any one of clauses 2 to 34, except for not being subject to the proviso of clause 1.
47. The use of clause 46, wherein the particles are as defined in any one of clauses 2 to 34.
48. The use of any one of clauses 45 to 47, wherein the method comprises the contacting a substrate with water and the bleaching formulation further comprises one or more of the particles.
49. The use of clause 48, wherein the temperature of the mixture resultant from the contacting is set to be no higher than that at which the coating material melts.

The following non-limiting examples below serve to illustrate the invention further.

EXPERIMENTAL $[Mn_2(\mu\text{-}O)_3(Me_3TACN)_2](CH_3COO)_2$ (as 3.5 wt-% aqueous solution in acetate buffer pH 5, made from 2.4 wt-% Na-acetate, 1.8 wt-% glacial acetic acid and adjusted to pH 5) was obtained as disclosed elsewhere (WO 2006/125517). $[Mn_2(\mu\text{-}O)_2(\mu\text{-}CH_3COO)\ (Me_4DTNE)]Cl_2.H_2O$ (87% purity level) was prepared as disclosed elsewhere (WO 2011/106906 (Unilever)).

Experiment 1

Evidence that the Presence of Clay Inhibits the Viscosity Loss of Wood Pulp by $[Mn_2(\mu\text{-}O)_3(Me_3TACN)_2]^{2+}$ (1a) An aqueous bleaching solution containing 0.5 g/l $Na_2CO_3$, 11.75 mmol/l $H_2O_2$ (35 wt-% ex Merck), 0.63 g/l of Marlon AS3 (Na-LAS), ex Sasol Germany, 0.32 g/l Lutensol AO7 (non-ionic), ex BASF, 0.055 g/l Dequest 2047 (which is 34 wt-% based on the full acidic form of the sequestrant and supplied by Thermphos) of pH 10.5 was prepared. Once done 1.5 μmol/l of $[Mn_2(\mu\text{-}O)_3(Me_3TACN)_2](CH_3COO)_2$ was added followed by the eucalyptus wood-pulp. The eucalyptus wood-pulp samples were treated at 65° C. for 15 min for 3 times at 5% consistency (which means 5 wt-% solid dry wood pulp in water), wherein the pulp samples were filtered off and washed with demineralised water between the treatment processes. The brightness values were determined as disclosed in WO 2011/128649.

(1 b) Experiment 1a above was repeated without catalyst (blank).

(1c) Experiment 1a above was repeated with catalyst in the presence of 10 mg of bentonite clay (ex Sigma Aldrich) per 20 ml of the bleaching solution.

Brightness values of 80.3 (exp 1a), 76.2 (exp 1b) and 78.4 (exp 1c) were obtained, showing that some inhibition of bleaching performance due to the catalyst occurred when the clay was added.

The same batches of treated pulp as described above (experiment 1a, b and c) were used to determine viscosity loss. Viscosity loss was determined by dissolving the wood pulp in Cu(ethylenediamine) solutions, as described elsewhere (SCAN-CM 15:99). First the pulp cellulose was dissolved in Cu solutions with ethylenediamine, according to the following method: Approximately 110 mg air dried pulp was weighted into a conical flask and suspended in 10 mL distilled water. Seven pieces of copper wire were added and the suspension was shaken for 30 min. Then, 10 mL 1M Cu(ethylenediamine) was added and the conical flask was filled up completely with 0.5 M Cu(ethylenediamine) so that no air was present anymore. The total volume of the solution was between 30 and 33 mL. The solution was shaken for 30 min to dissolve all pulp.

Subsequently the viscosity of the solution was determined as follows: The efflux time of the solution was determined using a capillary viscometer used (supplied by Rheotek) that was equipped with a water jacket to keep the temperature steady. The water jacket was connected to a water bath with temperature set to 25 C.

Calculations to determine the intrinsic viscosity were done as described in the Ethiopian ISO 5351:2012 (https://law.resource.org/pub/et/ibr/et.iso.5351.ds.2012.pdf).

This value was later used to calculate the Degree of polymerization of the pulp using the following equation $[\eta]=Q\times DP^{a}$ With $[\eta]$: intrinsic viscosity, DP: Degree of polymerization, Q=2.28 and a=0.76 More details about the origin of the equation and the values for the Q and a parameters can be found in Gruber, E., Gruber, R.: Viskosimetrische Bestimmung des Polymerisationsgrades von Cellulose. Das Papier 35(1981):4, 133-141

Marx-Figini, M.: Significance of the intrinsic viscosity ratio of unsubstituted and nitrated cellulose in different solvents. Angew. Makromol. Chemie 72(1978), 161-171

The s-factor (damage factor) was calculated according O. Eisenhut, Melliand's Textileberichte, 22, 424-426 (1941).

The values are denoted as s-factors: a higher value indicates more viscosity loss of the cellulose polymer chain and therefore a higher chemical damage factor. The experiments conducted were with 1.5 μmol/l of $[Mn_2(\mu\text{-}O)_3(Me_3TACN)_2](CH_3COO)_2$ (1a), without catalyst (1 b) and with 1.5 μmol/l of $[Mn_2(\mu\text{-}O)_3(Me_3TACN)_2](CH_3COO)_2$ in the presence of 10 mg of bentonite clay per 20 ml of the bleaching solution (1c).

Damage factors (s factors) of 0.28 (exp 1a), 0.12 (exp 1b) and 0.16 (exp 1c) were obtained, showing that the cellulose damage factor of the experiment with catalyst and clay is very similar to the blank, suggesting that the cellulose damage activity is reduced to a large extent.

Experiment 2

Evidence that the Presence of Clay Inhibits the Viscosity Loss of Wood Pulp by $[Mn_2(\mu\text{-}O)_2(\mu\text{-}CH_3COO)(Me_4DTNE)]^{2+}$ The same type of experiments using eucalyptus wood pulp as described above were done, except for using a heat-up profile (from 25° C. to 85° C. at 1.33° C./min temperature increase and then leaving the solutions for 15 min at 85° C.) and using $[Mn_2(\mu\text{-}O)_2(\mu\text{-}CH_3COO)(Me_4DTNE)]^{2+}$ as bleaching catalyst. When the solution was reaching 85° C. (after appr 45 min), an additional aliquot of hydrogen peroxide (11.8 mmol/l) was added to prevent loss of bleaching or damage due to peroxide decomposition. These experiments were done at higher temperatures and at much higher catalyst levels, as it is known that $[Mn_2(\mu\text{-}O)_2(\mu\text{-}CH_3COO)(Me_4DTNE)]^{2+}$ gives a weaker cellulose damage profile than $[Mn_2(\mu\text{-}O)_3(Me_3TACN)_2]^{2+}$ (US 2001/0025695).

The bleaching solutions initially consisted of 0.5 g/l $Na_2CO_3$, 11.75 mmol/l $H_2O_2$ (35 wt-% ex Merck), optionally 10 μmol/l of $[Mn_2(\mu\text{-}O)_2(\mu\text{-}CH_3COO)(Me_4DTNE)]^{2+}$ and 0.183 mmol/l of DTPA (diethylenetriamine-N,N,N',N'',N''-pentaacetate (50 wt-%—Dissolvine D50, ex Akzo Nobel)

Experiment 2a was done using 10 μmol/l of $[Mn_2(\mu\text{-}O)_2(\mu\text{-}CH_3COO)(Me_4DTNE)]^{2+}$ Experiment 2b was done using no catalyst with only hydrogen peroxide (blank), Experiment 2c was done using 10 μmol/l of $[Mn_2(\mu\text{-}O)_2(\mu\text{-}CH_3COO)(Me_4DTNE)]^{2+}$ in the presence of 20 mg bentonite clay per 20 ml of the bleaching solution that was added when the solution reached a temperature of 45° C.

Brightness values of 88.3 (exp 2a), 80.0 (exp 1b) and 85.4 (exp 2c) were obtained, showing that some inhibition of bleaching performance due to the catalyst occurred when the clay was added.

The same treated wood-pulp samples as described above (2a-c) were used to determine viscosity loss as outlined in experiment 1.

The damage factors (s factors) of 0.38 (exp 2a), 0.03 (exp 2b) and 0.18 (exp 2c) were obtained, showing that the cellulose damage factor of the experiment with catalyst and clay is clearly reduced compared to the solution that did not contain clay.

Experiment 3

Evidence that Carbon Black Gives Inhibition of the Bleaching Activity on Tea Stains by $[Mn_2(\mu\text{-}O)_3(Me_3TACN)_2]^{2+}$ Single-wash bleaching experiments were carried out as described in Experiment 1 but with the following differences:

20 mg Lauric acid (ex Merck) was added to the bleaching solution

The substrate used was BC1 stain (tea stain) purchased from CFT BV (Vlaardingen, The Netherlands)

The bleaching activity of the catalyst was measured as ΔR* values at 460 nm as disclosed elsewhere (EP0909809B/Unilever), except for drying the BC-1 test cloths, that was in this case done by drying under ambient conditions.

Several conditions were tested, each one based on the bleaching solution described in Experiment 1a with the following particularities:

(a) With 1.5 μmol/l of $[Mn_2(\mu\text{-}O)_3(Me_3TACN)_2](CH_3COO)_2$ (b) As described above in the absence of catalyst (blank)

(c) As described above in experiment 3a but this time 20 mg of bentonite clay per 20 ml was added to the washing solution before the 1.5 μmol/l of $[Mn_2(\mu\text{-}O)_3(Me_3TACN)_2](CH_3COO)_2$ was added. The solution was left for 15 min at RT before introduction of the BC-1.

(d) As described above in Experiment 3(a) but this time 20 mg of carbon black (Evonik) per 20 ml was added to the washing solution before the 1.5 μmol/l of $[Mn_2(\mu\text{-}O)_3(Me_3TACN)_2](CH_3COO)_2$. The solution was left for 15 min at RT before introduction of the BC-1.

The bleaching results obtained were 13.8 (exp 3a), 5.8 (exp 3b), 6.4 (exp 3c), 5.4 ΔR points (exp 3d). These results show that besides the bentonite clay, also carbon black gives an efficient reduction of the bleaching performance of the catalyst, suggesting adsorption processes onto the carbon black material.

Experiment 4

Tests to Show that Pellets Containing Bentonite Clay Mixed with Lauric Acid Show Efficient Inhibition of the Tea-Stain Bleaching Activity by the Catalysts Only Above the Melting Point of Lauric Acid In the next set of experiments fatty-acid granules containing the bentonite clay have been prepared. Lauric acid (ex Merck), mp 43° C., was used to prepare fatty acid-bentonite clay (50-50 wt-%) pellets on a one gram scale. The fatty acid was melted by heating it in a water-bath just above the melting point, then clay was added and mixed well with the molten fatty acid. Using a pipette the fatty acid-clay mixture was dropwise spread on a glass plate. When the fatty acid-clay drops cooled down, pellets of about 20-25 mg were obtained.

The bleaching solutions containing $Mn_2(\mu\text{-}O)_3(Me_3TACN)_2](CH_3COO)_2$ (in experiments a, c and d) also contained the same ingredients as given in experiment 1 (except the $H_2O_2$ content was now 11 mmol/l).

The performance of the bleaching system was assessed using BC-1 stains as described for experiment 3 at 65° C. and 30° C.

(a) with 1.5 μmol/l of $[Mn_2(\mu\text{-}O)_3(Me_3TACN)_2](CH_3COO)_2$ and 20 mg lauric acid (b) without catalyst (blank), with 20 mg lauric acid (c) with 1.5 μmol/l of $[Mn_2(\mu\text{-}O)_3(Me_3TACN)_2](CH_3COO)_2$ and 20 mg of bentonite clay per 20 ml of the bleaching solution and 20 mg lauric acid (d) with 1.5 μmol/l of $[Mn_2(\mu\text{-}O)_3(Me_3TACN)_2](CH_3COO)_2$ and 40 mg of lauric acid/bentonite clay (50/50 wt-%) pellet per 20 ml of the bleaching solution.

Similarly, experiments 4a and 4d were repeated using 5 μmol/l of $[Mn_2(\mu\text{-}O)_2(\mu\text{-}CH_3COO)(Me_4DTNE)]^{2+}$ at 85° C. and 30° C. for 15 min instead of 1.5 μmol/l of $[Mn_2(\mu\text{-}O)_3(Me_3TACN)_2](CH_3COO)_2$. The bleaching solutions containing $[Mn_2(\mu\text{-}O)_2(\mu\text{-}CH_3COO)(Me_4DTNE)]^{2+}$ also contained the same ingredients as given in experiment 1, except for the usage of 1.25 g/l Lutensol (non-ionic surfactant, ex BASF) and absence of Na-LAS in the bleaching solution and the $H_2O_2$ content which was 11 mmol/l.

The results are given in Table 1 below.

TABLE 1

BC-1 stain bleaching performance of the catalysts in the presence and absence of clay-fatty acid pellets at 30 and 65° C. (for $[Mn_2(\mu\text{-}O)_3(Me_3TACN)_2]^{2+}$) or 30° C. and 85° C. (for $[Mn_2(\mu\text{-}O)_2(\mu\text{-}CH_3COO)(Me_4DTNE)]^{2+}$).

| | 30° C. | 65° C. | 85° C. |
|---|---|---|---|
| 1.5 μmol/l of $[Mn_2(\mu\text{-}O)_3(Me_3TACN)_2]^{2+}$ | 10.7 | 12.7 | n.d. |
| Without $[Mn_2(\mu\text{-}O)_3(Me_3TACN)_2]^{2+}$ | 3.3 | 5.7 | n.d. |
| 1.5 μmol/l of $[Mn_2(\mu\text{-}O)_3(Me_3TACN)_2]^{2+}$ with bentonite clay | 5.3 | 7.4 | n.d. |
| 1.5 μmol/l of $[Mn_2(\mu\text{-}O)_3(Me_3TACN)_2]^{2+}$ with lauric acid/bentonite clay pellets | 8.6 | 7.5 | n.d. |
| 5 μmol/l of $[Mn_2(\mu\text{-}O)_2(\mu\text{-}CH_3COO)(Me_4DTNE)]^{2+}$ | 11.6 | n.d. | 23.0 |
| Without $[Mn_2(\mu\text{-}O)_2(\mu\text{-}CH_3COO)(Me_4DTNE)]^{2+}$ | 4.1 | n.d. | 10.5 |
| 5 μmol/l of $[Mn_2(\mu\text{-}O)_2(\mu\text{-}CH_3COO)(Me_4DTNE)]^{2+}$ with bentonite clay | 5.4 | n.d. | 13.3 |
| 5 μmol/l of $[Mn_2(\mu\text{-}O)_2(\mu\text{-}CH_3COO)(Me_4DTNE)]^{2+}$ with lauric acid/bentonite clay pellets | 9.8 | n.d. | 13.5 |

n.d. not determined

These results show that at 65° C. in the presence of bentonite clay-lauric acid pellets the performance of $[Mn_2(\mu\text{-}O)_3(Me_3TACN)_2]^{2+}$ is reduced significantly to a similar value as observed by using the clay (without the fatty acid), suggesting that when the lauric acid melts, the catalyst gets exposed to the clay that is then released.

At 30° C., however, the performance of the $[Mn_2(\mu\text{-}O)_3(Me_3TACN)_2]^{2+}$ in the presence of the clay only is much worse than when using the lauric acid/clay pellets, showing that at this low temperature the lauric acid clay pellets do not release the clay as the melting temperature of lauric acid has not been reached. Some of the clay on the outer layer may still be in contact with the bleaching solution, explaining the somewhat reduced performance of the catalyst under these conditions (when the clay would be fully protected, the bleaching performance should be the same).

The results obtained when using $[Mn_2(\mu\text{-}O)_2(\mu\text{-}CH_3COO)(Me_4DTNE)]^{2+}$ point to the same conclusion: at low temperatures (30° C., the clay is not released, whilst at 85° C., far above the melting point of the fatty acid, the bleaching performance is reduced due to catalyst adsorption on the released clay (and is similar to the value of clay added only).

Experiment 5

Tests to Show that Pellets Containing Bentonite Clay Mixed with Lauric Acid Show Only Efficient Inhibition of the Degradation of Starch by $[Mn_2(\mu\text{-}O)_3(Me_3TACN)_2]^{2+}$ Above the Melting Point of Lauric Acid Model experiments to assess starch degradation as a model for cellulose degradation using $[Mn_2(\mu\text{-}O)_3(Me_3TACN)_2]^{2+}$ have been carried out as well. These model experiments were done as starch is much more sensitive towards degradation than cellulose and therefore also at low temperature damage activity by $[Mn_2(\mu\text{-}O)_3(Me_3TACN)_2]^{2+}$ can be monitored. The substrate used for these experiments was a dyed crosslinked amylose purchased from Megazyme (trade name Amylazyme). When the amylose (starch) is destroyed, the dye is released and the extent of starch degradation can be monitored by measuring the Absorbance of the solution at 590 nm (maximum absorption for the dye).

This allowed us to show that the clay mixed with lauric acid is not released at low temperature leading to significant starch degradation by the catalyst, whilst at high temperature, this damage activity is inhibited due to the release of clay and consequently inactivation of the catalyst by the clay.

An aqueous solution containing 0.5 g/l $Na_2CO_3$, 11.0 mmol/l $H_2O_2$ (35 wt-% ex Merck), 2.5 μmol/l of $[Mn_2(\mu\text{-}O)_3(Me_3TACN)_2](CH_3COO)_2$, 0.055 g/l Dequest 2047 (which is 34 wt-% based on the full acidic form of the sequestrant and supplied by Thermphos) of pH 10.5 was used for these experiments. All experiments were done at 5 mL scale. Further 9 mg of lauric acid (ex Merck), and 1 mg of bentonite clay (ex Sigma-Aldrich), were used (either only lauric acid (b), or both ingredients separately added (c) or dosed together as a pellet (d)), as shown in experiment 4. Also a blank was done (lauric acid without catalyst—experiment a) It should be noted that in experiment 4, the weight ratio of lauric acid/clay was around 1/1, whilst for this experiment the weight ratio was 9/1.

The temperatures used were 30° C. (30 min) and 65° C. (5 min)—the experiment at low temperature was done for a longer period of time than the high temperature experiment, to ensure that enough dye is released for accurate measurements.

The general procedure was as follows: demineralised water, sodium carbonate, and sequestrant were added in a reactor tube and place in a waterbath at 65° C. or 30° C. The solution had an initial pH of 10.5 and was stirred continuously. After the solution was heated up, $H_2O_2$ and the catalyst were added (and pH was adjusted to pH 10.5). Then lauric acid/clay were added, whereafter a starch (amylase) pellet (ex Megazyme) was introduced. The starch pellet contains a blue dye which is released if the starch is degraded. The more starch degraded, the more dye is released. After 5 minutes of reaction time (for 65° C. experiments) or 30 minutes reaction time (for 30° C. experiments) the reactor tubes were taken out of the waterbath and placed in ice water to stop the reaction. The samples were centrifuged at 4000 rpm for 2 minutes so that the solid material was separated from the liquid. 4*100 uL of the clear (blue) liquid was pipetted in 4 wells of the MTP (microtiter plate) and the absorbance at 590 nm was measured using a Multiskan microtiterplate spectrophotometer (model Multiskan EX, supplier Thermo Scientific).

The results of the experiments are shown in Table 2 below.

TABLE 2

Starch degradation experiments using $[Mn_2(\mu\text{-}O)_3(Me_3TACN)_2]^{2+}$ using clay-fatty acid pellets at 30° C. (30 min) and 65° C. (5 min).

| | | 30° C. | 65° C. |
|---|---|---|---|
| (a) | Without $[Mn_2(\mu\text{-}O)_3(Me_3TACN)_2]^{2+}$ with lauric acid | 0.12 | 0.22 |
| (b) | $[Mn_2(\mu\text{-}O)_3(Me_3TACN)_2]^{2+}$ with lauric acid | 0.56 | 1.04 |

TABLE 2-continued

Starch degradation experiments using $[Mn_2(\mu\text{-}O)_3(Me_3TACN)_2]^{2+}$ using clay-fatty acid pellets at 30° C. (30 min) and 65° C. (5 min).

| | | 30° C. | 65° C. |
|---|---|---|---|
| (c) | $[Mn_2(\mu\text{-}O)_3(Me_3TACN)_2]^{2+}$ with lauric acid and bentonite clay added separately | 0.15 | 0.23 |
| (d) | $[Mn_2(\mu\text{-}O)_3(Me_3TACN)_2]^{2+}$ with lauric acid/bentonite clay pellets | 0.52 | 0.29 |

The results in Table 2 show the following:

(a) The blanks ($H_2O_2$ without catalyst) show some dye release at 30 and 65° C.

(b) Addition of the catalyst with lauric acid show much higher release of the dye at both temperatures, although the dye release at 65° C. is much higher than at 30° C., despite the much shorter reaction time.

(c) Addition of clay leads to a strong inhibition of the dye release presumably due to the catalyst adsorption on the bentonite clay, which is noted at both temperatures (i.e. the dye release is now similar to the blanks (a).

(d) Addition of the pellet containing clay and lauric acid leads to a strong inhibition of the dye release only at 65° C., whilst at 30° C. the catalyst remains as active as in experiment b. This shows that at low temperature, the lauric acid/clay pellets remain intact, which will then not lead to an inactivation of the catalyst, whilst at high temperature (above the melting point of lauric acid), the clay is released and causes inhibition of the catalyst preventing it to give amylose degradation (as a model for cellulose damage).

Experiment 6

Tests to Show that the Addition of Catalase Enzyme Encapsulated into a Fatty Acid Pellet Leads to Hydrogen Peroxide Decomposition when the Pellet is Disintegrated at 65° C.

In this series of experiments it will be shown that the addition of a catalase enzyme incorporated into a fatty-acid pellet to the solution containing the catalyst and $H_2O_2$, leads to $H_2O_2$ decomposition only at a temperature where the lauric acid is molten.

An aqueous solution containing 0.5 g/l $Na_2CO_3$, 11.0 mmol/l $H_2O_2$ (35 wt-% ex Merck), 0.63 g/l of Marlon AS3 (Na-LAS), (ex Sasol Germany), 0.32 g/l Lutensol A07 (non-ionic), (ex BASF), 0.055 g/l Dequest 2047 (which is 34 wt-% based on the full acidic form of the sequestrant and supplied by Thermphos) of pH 10.5 was used for these experiments (all done at 100 mL scale).

Further, where appropriate, 25 mg lauric acid (ex Merck), 25 mg $CaCO_3$ (ex Sigma-Aldrich), 25 mg of the zeolite, Doucil 4A (ex PQ Corporation), and 1.75 μL of Terminox Supreme 1000 BCU (ex Novozymes) per 100 ml of solution were used (note that as 1.75 μL cannot be dosed accurately, a 100 times diluted solution was added (175 μL).

The aqueous catalase solution was brought onto $CaCO_3$ or zeolite Doucil 4A respectively in order to be able to make solid pellets containing lauric acid with the catalase Terminox Supreme. To 0.5 g $CaCO_3$ a solution of 35 uL of Terminox Supreme in 1.0 mL water was added, after which the solid was dried at 30° C. for 2 h. To 0.5 g Doucil 4A was added a solution of 35 μL Terminox Supreme (catalase) in 0.5 mL water, after which the solid was dried at 30° C. for 1.5 h. Incorporation in lauric acid of the solids containing the catalase Terminox Supreme was done by melting the lauric acid at 48° C., whereafter the solid was added. Using a pipette the lauric acid-solid ($CaCO_3$/Doucil 4A (1/1 w/w) with Terminox Supreme) mixture was dropwise spread on a glass plate. When the lauric acid drops cooled down, pellets of about 10-30 mg were obtained.

Hydrogen peroxide levels were determined by using a standard potassium permanganate titration (Vogel's Textbook of Quantitative Chemical Analysis, Fifth Edition, John Wiley & Sons, Inc., New York, 1989). These levels were determined at t=0 (before addition of catalase enzyme) and after 10 min at 65 and 30° C. respectively.

All hydrogen peroxide levels were determined without the manganese catalyst present, to show that the enzyme is active at 30 and 65° C., can be brought onto a solid support ($CaCO_3$ or zeolite Doucil 4A), and can be incorporated in a pellet containing lauric acid. The results are shown in Table 3 below.

TABLE 3

Hydrogen peroxide levels measured after 10 min reaction time (in % relative to initial values) at 30° C. (30 min) and 65° C. (5 min).

| | | 30° C. | 65° C. |
|---|---|---|---|
| (a) | No catalase + fatty acid (added separately) | 100.2 | 98.9 |
| (b) | Catalase + fatty acid (added separately) | 3.7 | 5.2 |
| (c) | Catalase on $CaCO_3$ + fatty acid (added separately) | 4.2 | 18.9 |
| (d) | Catalase on zeolite Doucil 4A + fatty acid (added separately) | 3.4 | 20.0 |
| (e) | Catalase on $CaCO_3$ incorporated into the fatty acid as a pellet | 77.6 | 16.7 |
| (f) | Catalase on zeolite Doucil 4A incorporated into the fatty acid as a pellet | 83.9 | 30.2 |

The experiments shown in Table 3 indicate the following:

(a) Both at 30 and 65° C. the hydrogen peroxide solutions are stable for 10 minutes when catalase enzyme is not added.

(b) Adding the catalase enzyme and fatty acid leads to a fast degradation of hydrogen peroxide at both temperatures, indicating that the enzyme is active to degrade hydrogen peroxide at 30 and 65° C., as expected from literature publications (cf. M. Subramanian Senthil Kannan, R. Nithyanandan, Indian Textile Journal, February 2008).

(c) Incorporation of the enzyme on solid $CaCO_3$, gives a very good enzyme activity at 30° C., whilst at 65° C. a slightly lower activity was found than the reference (b).

(d) Incorporation of the enzyme on solid zeolite Doucil 4A, gives a very good enzyme activity at 30° C., whilst at 65° C. a slightly lower activity was found than the reference (b).

(e) Incorporation of the catalase enzyme/$CaCO_3$ into the lauric acid as pellets, leads at 30° C. to a high level of hydrogen peroxide, showing that most of the enzyme is trapped within the pellet. At 65° C. the remaining hydrogen peroxide is similar to the value obtained when the catalase enzyme/$CaCO_3$ and lauric acid were added separately (c). This shows that at 30° C. the pellet is intact and does not allow the trapped enzyme to induce hydrogen peroxide decomposition, whilst at 65° C. the enzyme is released and active to decompose hydrogen peroxide.

(f) Incorporation of the catalase enzyme/zeolite Doucil 4A into the lauric acid as pellets, leads at 30° C. to a high level of hydrogen peroxide, showing that most of the enzyme is trapped within the pellet. At 65° C. the remaining hydrogen peroxide is similar to the value obtained when the catalase enzyme/zeolite Doucil 4A and lauric acid were added separately (d). Also these results show that at 30° C. the pellet is intact and does not allow the trapped enzyme to induce hydrogen peroxide decomposition, whilst at 65° C. the enzyme is released and active to decompose hydrogen peroxide.

Experiment 7

Tests to Show that the Addition of Catalase Enzyme Encapsulated into a Fatty Acid Pellet Leads to Inhibition of Stain Bleaching Only when the Enzyme is Released from the Pellet An aqueous solution containing 0.5 g/l $Na_2CO_3$, 11.0 mmol/l $H_2O_2$ (35 wt-% ex Merck), 1.5 μmol/l of $[Mn_2(\mu\text{-}O)_3(Me_3TACN)_2](CH_3COO)_2$, 0.63 g/l of Marlon AS3 (Na-LAS), (ex Sasol Germany), 0.32 g/l Lutensol A07 (non-ionic), (ex BASF), 0.055 g/l Dequest 2047 (which is 34 wt-% based on the full acidic form of the sequestrant and supplied by Thermphos) of pH 10.5 was used for these experiments (all done at 20 mL scale).

Further, where appropriate, 5 mg lauric acid (ex Merck), 5 mg $CaCO_3$ (ex Sigma-Aldrich), 5 mg, zeolite, Doucil 4A (ex PQ Corporation), and 0.35 μL of Terminox Supreme 1000 BCU (ex Novozymes) per 20 ml of solution were used (again, the catalase solution has been diluted by 100 times from which 35 μL was added to the solution).

BC-1 stain bleaching activity was determined as outlined in experiment 3.

First a calibration of the extent of BC-1 bleaching after 15 minutes at different levels of hydrogen peroxide and 1.5 μmol/l of $[Mn_2(\mu\text{-}O)_3(Me_3TACN)_2](CH_3COO)_2$ was determined (at 30 and 65° C.). Results are shown in Table 4 below.

TABLE 4

ΔR bleaching values obtained after 15 minutes using 1.5 μmol/l of $[Mn_2(\mu\text{-}O)_3(Me_3TACN)_2](CH_3COO)_2$ and different levels of hydrogen peroxide at 30 and 65° C.

| | $H_2O_2$ level (mmol/l) | 30° C. | 65° C. |
|---|---|---|---|
| (a) | 11 | 10.1 | 20.1 |
| (b) | 8.25 | 9.2 | 17.5 |
| (c) | 5.5 | 8.0 | 15.2 |
| (d) | 2.75 | 6.2 | 11.0 |
| (e) | 0 | 0.3 | 1.6 |

The results above show that with relatively low levels of hydrogen peroxide still a very significant bleaching effect can be obtained, and combined with the result from experiment 6, the effect of the catalase enzyme should be noticeable.

Subsequently, the effect of the addition of catalase enzyme incorporated into the fatty acid/$CaCO_3$ or fatty acid/zeolite Doucil 4A on the BC-1 bleaching was assessed at 30 and 65° C. (15 min). Results are shown in Table 5 below.

TABLE 5

ΔR bleaching values (BC-1 stains) obtained after 15 minutes using 1.5 μmol/l of $[Mn_2(\mu\text{-}O)_3(Me_3TACN)_2](CH_3COO)_2$, 11 mM $H_2O_2$, and catalase enzyme incorporated in the lauric acid pellet at 30 and 65° C.

| | | 30° C. | 65° C. |
|---|---|---|---|
| (a) | Catalase solution + fatty acid (added separately) | 2.6 | 9.1 |
| (b) | Catalase on $CaCO_3$ + fatty acid (added separately) | 3.4 | 9.7 |
| (c) | Catalase on zeolite Doucil 4A + fatty acid (added separately) | 2.9 | 9.8 |
| (d) | Catalase on $CaCO_3$ incorporated into the fatty acid as a pellet | 9.3 | 10.7 |
| (e) | Catalase on zeolite Doucil 4A incorporated into the fatty acid as a pellet | 9.6 | 12.7 |

The results presented in Table 5 above show that (a) Addition of the catalase enzyme leads to a very significant reduction of the bleaching activity at 30 and 65° C., showing that the amount of hydrogen peroxide left is low (less than 2.75 mM—see Table 4)

(b) Similar results were obtained when the calcium carbonate/catalase enzyme solid was dosed.

(c) Similar results were obtained when the zeolite/catalase enzyme solid was dosed.

(d) When the catalase enzyme/$CaCO_3$ was incorporated into the lauric acid pellet, the bleaching result at 65° C. is similar to the one where the enzyme/$CaCO_3$ was added separately from the lauric acid (exp b), but at 30° C. now the bleaching activity is much higher than the one obtained at the comparative experiment b. This shows again that the enzyme remains trapped at 30° C. when dosed in the lauric acid pellet.

(e) Similar results were obtained when using the zeolite/catalase/lauric acid pellet vs when the zeolite/enzyme was added separately from the lauric acid (experiment c).

Therefore we conclude that similarly to the hydrogen peroxide stability experiments shown in Experiment 6, the enzyme can be incorporated into lauric acid ensuring that the enzyme is only active to degrade hydrogen peroxide when lauric acid melts allowing the enzyme to be released.

Experiment 8

Tests to Show that the Addition of Catalase Enzyme Encapsulated into a Fatty Acid Pellet Leads to Decreased Brightness of Wood-Pulp and Decreased Cellulose Degradation of Wood-Pulp when the Catalase Enzyme is Released from the Pellet An aqueous solution containing eucalyptus wood-though the pulp (at 5% consistency), 0.5 g/l $Na_2CO_3$, 0.63 g/l of Marlon AS3 (Na-LAS), ex Sasol Germany, 0.32 g/l Lutensol A07 (non-ionic), 1.5 μmol/l of $[Mn_2(\mu\text{-}O)_3(Me_3TACN)_2](CH_3COO)_2$, 0.055 g/l Dequest 2047 (which is 34 wt-% based on the full acidic form of the sequestrant and supplied by Thermphos) of pH 10.5 was used for these experiments (all done at 20 mL scale).

Further, where appropriate, 11.0 mmol/l $H_2O_2$ (35 wt-% ex Merck), 5 mg lauric acid (ex Merck), 5 mg $CaCO_3$ (ex Sigma-Aldrich), 5 mg, zeolite, Doucil 4A (ex PQ Corporation), and 10.0 μL of Terminox Supreme 1000 BCU (ex Novozymes) per 20 ml of solution were used.

The aqueous catalase solution was brought onto $CaCO_3$ or zeolite Doucil 4A respectively in order to be able to make solid pellets containing lauric acid with the catalase Terminox Supreme. To 0.5 g $CaCO_3$ or zeolite Doucil 4A 1 mL of Terminox Supreme was added, after which the solid was dried at overnight at RT. Incorporation in lauric acid of the solids containing the catalase Terminox Supreme was done by melting the lauric acid at 48° C., whereafter the solid was added. Using a pipette the lauric acid-solid ($CaCO_3$/Doucil 4A with Terminox Supreme) mixture was dropwise spread on a glass plate. When the lauric acid drops cooled down, pellets of about 10-30 mg were obtained. The lauric acid/solid ratio of the pellets was 1/1 w/w.

The eucalyptus pulp was treated 3 times for 15 min at 65° C., wherein the pulp samples were filtered off and washed with demineralised water between the treatment processes. The brightness values were determined as disclosed in WO 2011/128649. The damage was determined by monitoring the viscosity loss of the pulp dissolved in Cu(ethylenediamine) solution, as described in Experiment 1.

TABLE 6

Brightness and damage (s-factor) of eucalyptus pulp treated 3 times at 65° C.

| | | Brightness | s-factor |
|---|---|---|---|
| (a) | 11 mM $H_2O_2$ + 5 mg lauric acid | 83.8 | 0.41 |
| (b) | No $H_2O_2$ + 5 mg lauric acid | 70.7 | 0.10 |
| (c) | 11 mM $H_2O_2$ + 10 uL Catalase + 5 mg lauric acid | 74.1 | 0.12 |
| (e) | 11 mM $H_2O_2$ + 10 uL Catalase on 5 mg $CaCO_3$ + 5 mg lauric acid | 72.3 | 0.17 |
| (f) | 11 mM $H_2O_2$ + 10 uL Catalase on 5 mg zeolite Doucil 4A + 5 mg lauric acid | 72.7 | 0.21 |
| (g) | 11 mM $H_2O_2$ + 10 uL Catalase on 5 mg $CaCO_3$ incorporated in 5 mg lauric acid | 74.0 | 0.21 |
| (h) | 11 mM $H_2O_2$ + 10 uL Catalase on 5 mg zeolite Doucil 4A incorporated in 5 mg lauric acid | 75.6 | 0.19 |

The results presented in table 6 above shown that:

(a)+(b) The presence of $H_2O_2$ gives a higher brightness and damage than when no $H_2O_2$ is present.

(c) Addition of catalase enzyme to the reaction mixture decreases the brightness and damage compared to (a). This indicates that (part of) the $H_2O_2$ is decomposed by the catalase.

(d)+(e) Addition of catalase enzyme deposited on a solid ($CaCO_3$ 3 or zeolite Doucil 4A) decreases the brightness and damage compared to (a). This indicates that (part of) the $H_2O_2$ is decomposed by the catalase.

(f)+(g) Addition of catalase enzyme deposited on a solid ($CaCO_3$ or zeolite Doucil 4A) and incorporated in lauric acid decreases the brightness and damage compared to (a).

This indicates that the catalase/solid is released from its fatty acid coating and thereby decomposes $H_2O_2$.

It should be noted that when a standard bleaching experiment is carried out under the conditions as for experiment 8(a) except for using 1.4 mmol/l $H_2O_2$ the bleaching effect on wood pulp is 79.2 brightness points instead of 83.8 brightness points (for 11 mmol/l $H_2O_2$). Without $H_2O_2$ only 70.7 brightness points is obtained). Similarly the s-factor (damage factor) on wood-pulp cellulose varies from 0.41 (for 11 mmol/l $H_2O_2$), 0.38 (for 1.4 mmol/l $H_2O_2$), and 0.10 for the solution without any hydrogen peroxide.

These results indicate that relatively small amounts of hydrogen peroxide present in the bleaching solution lead to a significant bleaching effect and effect on cellulose damage. Therefore the results shown in table 6 (experiments c-h) indicate that the catalase enzyme decomposed at least 90% of the hydrogen peroxide in the course of the experiment.

The invention claimed is:

1. A bleaching formulation comprising one or more particles and a transition metal ion-containing bleaching catalyst separate from the particles, the particles comprising:

(i) a core comprising an inorganic solid support material selected from the group consisting of clays, aluminum silicates, silicates, silicas, carbon black and activated carbon, and/or a catalase enzyme or a mimic thereof; and an amount of about 0 to about 10 wt % of a transition metal ion-containing bleaching catalyst, the amount of the catalyst being with respect to the weight of the core; and (ii) a coating encapsulating the core, said coating comprising a material that melts at a temperature of between about 30° C. and about 90° C., with the proviso that, where the inorganic solid support material is talc or a clay, the core does not comprise a peroxy compound or source thereof or a catalase enzyme or mimic thereof, and, wherein said core reduce(s), upon melting of said coating, the oxidative propensity of a medium comprising hydrogen peroxide and said bleaching formulation.

2. The formulation of claim 1, wherein the inorganic solid support material is a clay.

3. The formulation of claim 2, wherein the clay is bentonite.

4. The formulation of claim 1, wherein the core comprises calcium carbonate-and/or zeolite-supported catalase.

5. The formulation of claim 1, wherein there is no transition metal ion-containing bleaching catalyst in the core.

6. The formulation of claim 1, wherein the catalyst separate to the particles comprises a mononuclear or dinuclear complex comprising a ligand of formula (I):

(I)

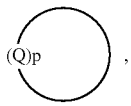

, wherein:

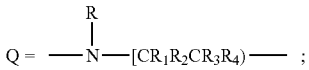

;

p is 3;

R is independently selected from the group consisting of hydrogen, $C_1$-$C_{24}$alkyl, $CH_2CH_2OH$ and $CH_2COOH$; or one R is linked to the nitrogen atom of another Q of another ring of formula (I) via a $C_2$-$C_6$ alkylene bridge, a $C_6$-$C_{10}$ arylene bridge or a bridge comprising one or two $C_1$-$C_3$ alkylene units and one $C_6$-$C_{10}$ arylene unit, which bridge may be optionally substituted one or more times with independently selected $C_1$-$C_{24}$ alkyl groups; and $R_1$, $R_2$, $R_3$, and $R_4$ are independently selected from H, $C_1$-$C_4$alkyl and $C_1$-$C_4$-alkylhydroxy.

7. The formulation of claim 6, wherein the catalyst separate to the particles comprises 1,2-bis(4,7-dimethyl-1,4,7-triazacyclonon-l-yl)ethane and the coating melts between about 50 and about 70° C.

8. The formulation of claim 6, wherein the catalyst separate to the particles comprises 1,4,7-trimethyl-1,4,7-triazacyclononane and the coating melts between about 30 and about 50° C.

9. The formulation of claim 1, wherein the catalyst separate to the particles comprises one or more counterions selected from the group consisting of $Cl^-$, $NO_3^-$, $SO_4^{2-}$ and acetate that are not coordinated to a transition metal ion of the catalyst.

10. The formulation of claim 1, which further comprises an alkali metal percarbonate.

11. The formulation of claim 1, which further comprises a surfactant.

12. A particle comprising:

(i) a core consisting essentially of an inorganic solid support material selected from the group consisting of clays, aluminum silicates, silicates, silicas, carbon black and activated carbon, and/or a catalase enzyme or a mimic thereof; and, (ii) a coating encapsulating the core, said coating comprising a material that melts at a temperature of between about 30° C. and about 90° C., with the proviso that, where the inorganic solid support material is talc or a clay, the core does not comprise a peroxy compound or source thereof or a catalase enzyme or mimic thereof; and, wherein said core reduce(s), upon melting of said coating, the oxidative propensity of a medium comprising hydrogen peroxide and a transition metal ion-containing bleaching catalyst.

13. A method comprising:

(a) contacting a substrate with water and a bleaching formulation to form a mixture, and, (b) setting temperature of the mixture;

wherein the bleaching formulation comprises one or more particles and a transition metal ion-containing bleaching catalyst salt separate from the particles, the particles comprising:

(i) a core comprising an inorganic solid support material selected from the group consisting of clays, aluminum silicates, silicates, silicas, carbon black and activated carbon, and/or a catalase enzyme or a mimic thereof; and an amount of about 0 to about 10 wt % of a transition metal ion-containing bleaching catalyst, the amount of the catalyst being with respect to the weight of the core; and (ii) a coating encapsulating the core, said coating comprising a material that melts at a temperature of between about 30° C. and about 90° C., wherein said core reduce(s), upon melting of said coating, the oxidative propensity of the mixture comprising hydrogen peroxide and said transition metal ion-containing bleaching catalyst, and, wherein the temperature of the mixture is set to be no higher than that at which said material of the coating melts.

14. A method comprising contacting a substrate with water and a bleaching formulation as defined in claim 1.

15. The method of claim 13, which is a method of cleaning a textiles or a non-woven fabric, the method comprising contacting the textile or the non-woven fabric with water and the bleaching formulation.

16. The method of claim 14, which is a method of cleaning a textiles or a non-woven fabric, the method comprising contacting the textile or the non-woven fabric with water and the bleaching formulation.

17. The method of claim 13, wherein the catalysts salt comprises a mononuclear or dinuclear complex comprising a ligand of formula (I):

(I)

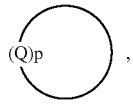

wherein:

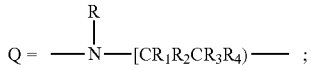

p is 3;

R is independently selected from the group consisting of hydrogen, $C_1$-$C_{24}$alkyl, $CH_2CH_2OH$ and $CH_2COOH$; or one R is linked to the nitrogen atom of another Q of another ring of formula (I) via a $C_2$-$C_6$ alkylene bridge, a $C_6$-$C_{10}$ arylene bridge or a bridge comprising one or two $C_1$-$C_3$ alkylene units and one $C_6$-$C_{10}$ arylene unit, which bridge may be optionally substituted one or more times with independently selected $C_1$-$C_{24}$ alkyl groups; and $R_1$, $R_2$, $R_3$, and $R_4$ are independently selected from H, $C_1$-$C_4$alkyl and $C_1$-$C_4$-alkylhydroxy.

18. The method of claim 14, wherein the catalysts salt comprises a mononuclear or dinuclear complex comprising a ligand of formula (I):

(I)

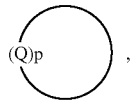

wherein:

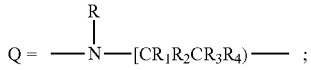

p is 3;

R is independently selected from the group consisting of hydrogen, $C_1$-$C_{24}$alkyl, $CH_2CH_2OH$ and $CH_2COOH$; or one R is linked to the nitrogen atom of another Q of another ring of formula (I) via a $C_2$-$C_6$ alkylene bridge, a $C_6$-$C_{10}$ arylene bridge or a bridge comprising one or two $C_1$-$C_3$ alkylene units and one $C_6$-$C_{10}$ arylene unit, which bridge may be optionally substituted one or more times with independently selected $C_1$-$C_{24}$ alkyl groups; and $R_1$, $R_2$, $R_3$, and $R_4$ are independently selected from H, $C_1$-$C_4$alkyl and $C_1$-$C_4$-alkylhydroxy.

19. The formulation of claim 6, wherein the catalyst separate to the particles comprises 1,4,7-trimethyl-1,4,7-triazacyclononane and the coating melts between about 40 and about 50° C.

20. The particle of claim 12, wherein said core contains no transition metal ion-containing bleaching catalyst.

* * * * *